US010295948B2

(12) United States Patent
Nakamura et al.

(10) Patent No.: US 10,295,948 B2
(45) Date of Patent: May 21, 2019

(54) IMAGE FORMING APPARATUS

(71) Applicants: Keigo Nakamura, Kanagawa (JP); Hirokazu Ishii, Tokyo (JP); Kenji Sugiura, Kanagawa (JP); Takehide Mizutani, Tokyo (JP); Atsushi Nagata, Kanagawa (JP); Naoto Kochi, Tokyo (JP); Yuuji Wada, Kanagawa (JP); Shinya Tanaka, Kanagawa (JP)

(72) Inventors: Keigo Nakamura, Kanagawa (JP); Hirokazu Ishii, Tokyo (JP); Kenji Sugiura, Kanagawa (JP); Takehide Mizutani, Tokyo (JP); Atsushi Nagata, Kanagawa (JP); Naoto Kochi, Tokyo (JP); Yuuji Wada, Kanagawa (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/483,548

(22) Filed: Apr. 10, 2017

(65) Prior Publication Data

US 2017/0300000 A1 Oct. 19, 2017

(30) Foreign Application Priority Data

Apr. 14, 2016 (JP) ..... 2016-081335
Feb. 13, 2017 (JP) ..... 2017-023927

(51) Int. Cl.
*G03G 15/00* (2006.01)
*G03G 21/20* (2006.01)
*G03G 15/16* (2006.01)

(52) U.S. Cl.
CPC ..... *G03G 15/80* (2013.01); *G03G 15/1675* (2013.01); *G03G 21/203* (2013.01)

(58) Field of Classification Search
CPC ... G03G 15/1665; G03G 15/80; G03G 21/203
See application file for complete search history.

(56) References Cited

U.S. PATENT DOCUMENTS

2010/0329707 A1* 12/2010 Yamada ..... G03G 15/161 399/44
2011/0229168 A1 9/2011 Shiraishi et al.
(Continued)

FOREIGN PATENT DOCUMENTS

JP 4-086678 3/1992
JP 9-146381 6/1997
(Continued)

OTHER PUBLICATIONS

U.S. Appl. No. 15/427,735, filed Feb. 8, 2017.
U.S. Appl. No. 15/432,392, filed Feb. 14, 2017.

*Primary Examiner* — Gregory H Curran
(74) *Attorney, Agent, or Firm* — Oblon, McClelland, Maier & Neustadt, L.L.P.

(57) ABSTRACT

An image forming apparatus including an image bearer, a transfer-bias power source, an environment sensor, and a controller. The controller controls the transfer-bias power source to change the DC component and the AC component, according to the at least one of temperature and humidity detected by the environment sensor and a duty of the transfer bias. The duty is A/(A+B)×100[%] where A denotes an area on a return-directional side to move toner from the recording sheet back to the image bearer, relative to a center value (Voff) of a maximum value and a minimum value of the transfer bias in one cycle of a waveform of the transfer bias, and B denotes an area on a transfer-directional side to move the toner from the image bearer to the recording sheet, relative to the center value (Voff) in the one cycle.

20 Claims, 11 Drawing Sheets

(56) References Cited

U.S. PATENT DOCUMENTS

| | | | | |
|---|---|---|---|---|
| 2012/0045231 | A1 | 2/2012 | Ogino et al. | |
| 2012/0045259 | A1 | 2/2012 | Nakamura et al. | |
| 2012/0230715 | A1 | 9/2012 | Ogino et al. | |
| 2012/0237234 | A1* | 9/2012 | Sugimoto | G03G 15/1675 399/50 |
| 2012/0243892 | A1 | 9/2012 | Nakamura et al. | |
| 2012/0328314 | A1 | 12/2012 | Sugimoto et al. | |
| 2013/0121714 | A1 | 5/2013 | Tanaka et al. | |
| 2013/0136468 | A1 | 5/2013 | Shimizu et al. | |
| 2013/0136477 | A1* | 5/2013 | Ogiyama | G03G 15/18 399/66 |
| 2013/0142531 | A1 | 6/2013 | Sugimoto et al. | |
| 2013/0308988 | A1 | 11/2013 | Tanaka et al. | |
| 2014/0010562 | A1 | 1/2014 | Tanaka et al. | |
| 2014/0079418 | A1 | 3/2014 | Tanaka et al. | |
| 2014/0328604 | A1* | 11/2014 | Tanaka | G03G 15/1675 399/66 |
| 2015/0212453 | A1 | 7/2015 | Tanaka | |
| 2016/0109832 | A1 | 4/2016 | Ohsugi et al. | |
| 2016/0161887 | A1 | 6/2016 | Sugiura et al. | |
| 2016/0161888 | A1 | 6/2016 | Wada et al. | |
| 2016/0246218 | A1 | 8/2016 | Tanaka | |
| 2016/0334739 | A1 | 11/2016 | Ohsugi et al. | |

FOREIGN PATENT DOCUMENTS

| | | |
|---|---|---|
| JP | 2006-267486 | 10/2006 |
| JP | 2008-058585 | 3/2008 |
| JP | 2013-231936 | 11/2013 |
| JP | 2013-237592 | 11/2013 |
| JP | 2015-127841 | 7/2015 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-081335, filed on Apr. 14, 2016 and Japanese Patent Application No. 2017-023927, filed on Feb. 13, 2017 in the Japan Patent Office, the entire disclosures of which are hereby incorporated by reference herein.

BACKGROUND

Technical Field

Embodiments of the present disclosure generally relate to an electrophotographic image forming apparatus, such as a copier, a printer, a facsimile machine, and a multifunction peripheral (MFP) having at least two of copying, printing, facsimile transmission, plotting, and scanning capabilities.

Related Art

In typical electrophotographic image forming apparatuses, an image bearer, such as a photoconductor, having been uniformly charged optically forms a latent image thereon according to image data. Then, a developing device develops the latent image with toner to form a toner image on an intermediate transfer member, such as an intermediate transfer belt, and a transfer device transfers the toner image from the intermediate transfer belt onto a recording medium either directly or indirectly. Subsequently, a fixing device fixes the transferred toner image on the recording medium.

Such image forming apparatuses adopt a method for controlling a direct current (DC) transfer bias, which is applied to a transfer device using a DC power source, by a constant current control. In recent years, various types of sheets of paper, such as leather patterns that provide luxurious impression and Japanese paper, are used as a recording material in the image forming apparatuses, and such types of sheets of paper are commercially available.

Such sheets of paper have uneven surfaces prepared by embossing the surfaces thereof to provide luxurious impression. In the uneven surfaces, toner is more difficult to transfer onto recesses than onto protrusions. Particularly when toner is transferred onto a recording sheet having a high degree of unevenness, a sufficient amount of toner is not transferred onto the recesses, resulting in white spots on the toner image.

SUMMARY

In an aspect of this disclosure, there is provided an improved image forming apparatus including an image bearer, a transfer-bias power source, an environment sensor, and a controller. The transfer-bias power source outputs a transfer bias including a direct current (DC) component and an alternating current (AC) component to transfer a toner image from the image bearer to a recording sheet. The environment sensor detects at least one of temperature and humidity within the image forming apparatus. The controller controls the transfer-bias power source to change the DC component and the AC component, according to the at least one of temperature and humidity detected by the environment sensor and a duty of the transfer bias. The duty is A/(A+B)×100[%] where A denotes an area on a return-directional side to move toner from the recording sheet back to the image bearer, relative to a center value (Voff) of a maximum value and a minimum value of the transfer bias in one cycle of a waveform of the transfer bias, and B denotes an area on a transfer-directional side to move the toner from the image bearer to the recording sheet, relative to the center value (Voff) in the one cycle.

In another aspect of this disclosure, there is provided an improved image forming apparatus including an image bearer, a transfer-bias power source, and a controller The transfer-bias power source outputs a transfer bias including a direct current (DC) component and an alternating current (AC) component to transfer a toner image from the image bearer to a recording sheet. The controller controls a printing speed and the transfer-bias power source to change the DC component and the AC component, according to the printing speed and a duty of the transfer bias. The duty is A/(A+B)×100[%] where A denotes an area on a return-directional side to move toner from the recording sheet back to the image bearer, relative to a center value (Voff) of a maximum value and a minimum value of the transfer bias in one cycle of a waveform of the transfer bias, and B denotes an area on a transfer-directional side to move the toner from the image bearer to the recording sheet, relative to the center value (Voff) in the one cycle.

In even another aspect of this disclosure, there is provided improved image forming apparatus including an image bearer, a transfer-bias power source, a transfer unit, a detector, and a controller. The transfer-bias power source to output a transfer bias including a direct current (DC) component and an alternating current (AC) component. The transfer unit receives the transfer bias to transfer a toner image from the image bearer to a recording sheet. The detector to detect a resistance of the transfer unit. The controller to control the transfer-bias power source to change the AC component, according to the resistance of the transfer unit detected by the detector and a duty of the transfer bias. The duty is A/(A+B)×100[%] where A denotes an area on a return-directional side to move toner from the recording sheet back to the image bearer, relative to a center value (Voff) of a maximum value and a minimum value of the transfer bias in one cycle of a waveform of the transfer bias, and B denotes an area on a transfer-directional side to move the toner from the image bearer to the recording sheet, relative to the center value (Voff) in the one cycle.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 4B:
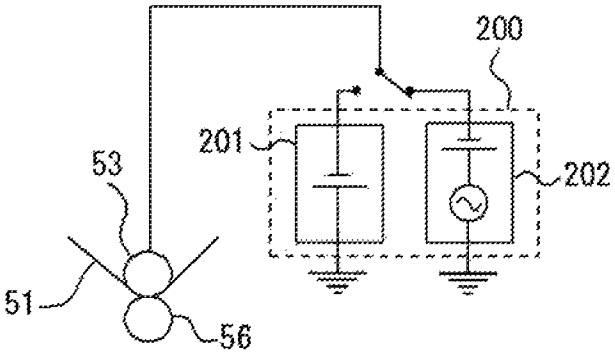
Figure 4A:
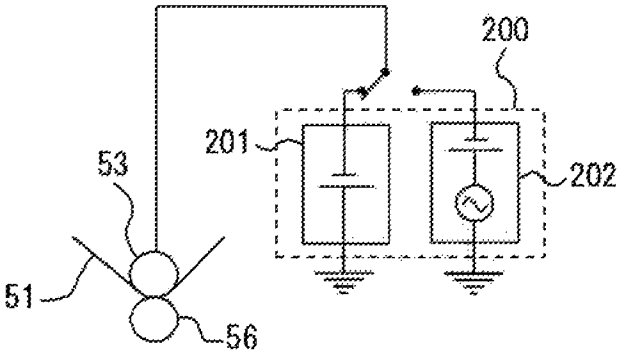
Figure 5:
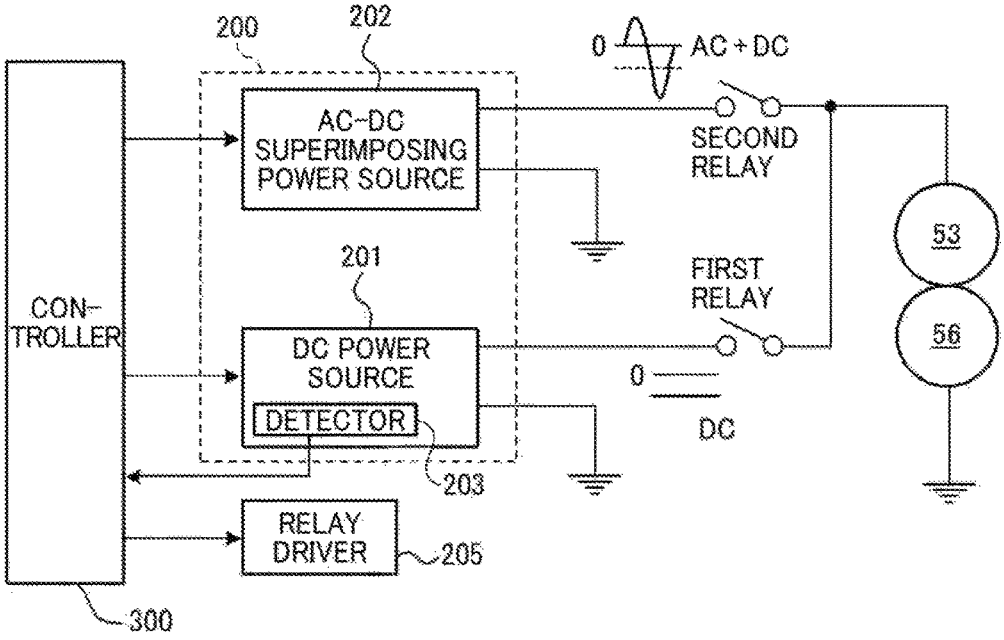
Figure 6:
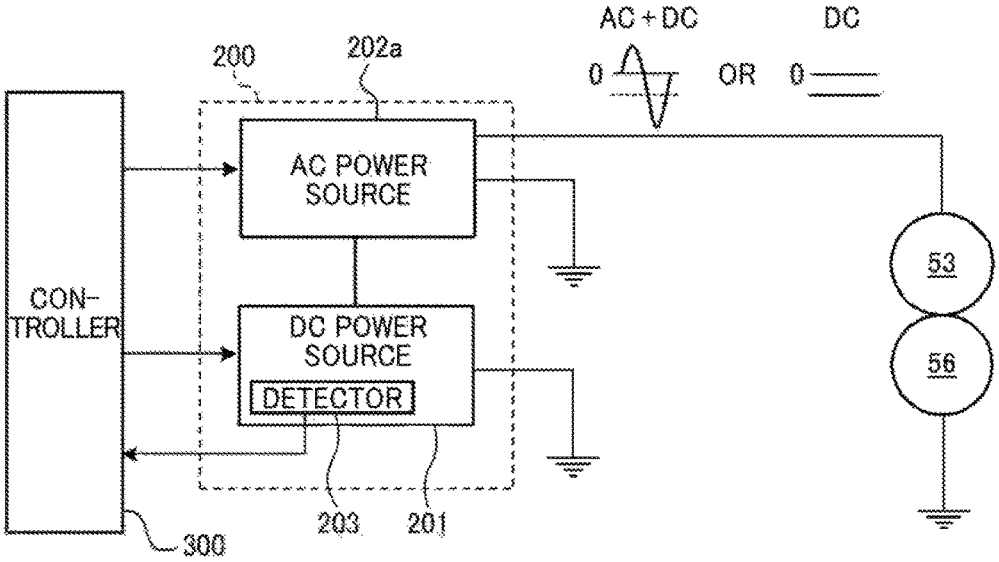
Figure 7:
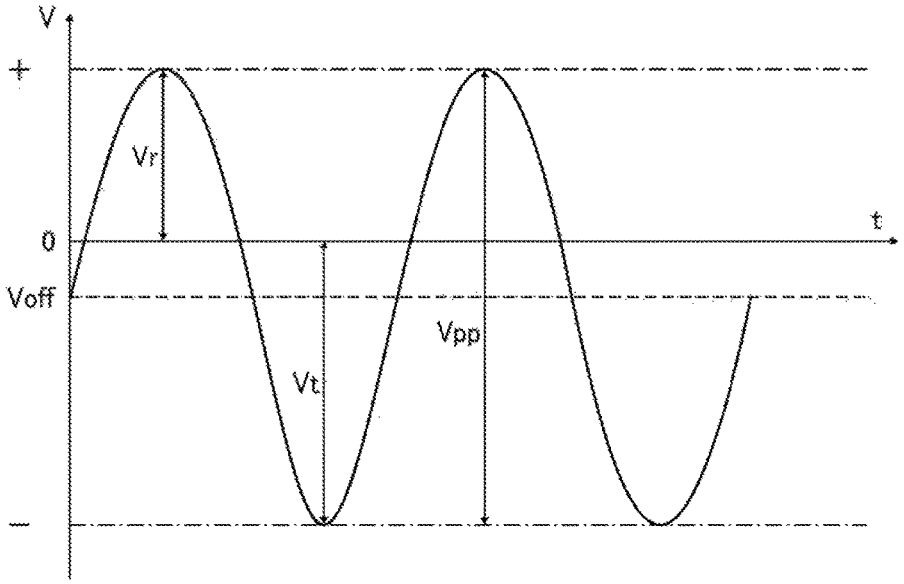
Figure 8:
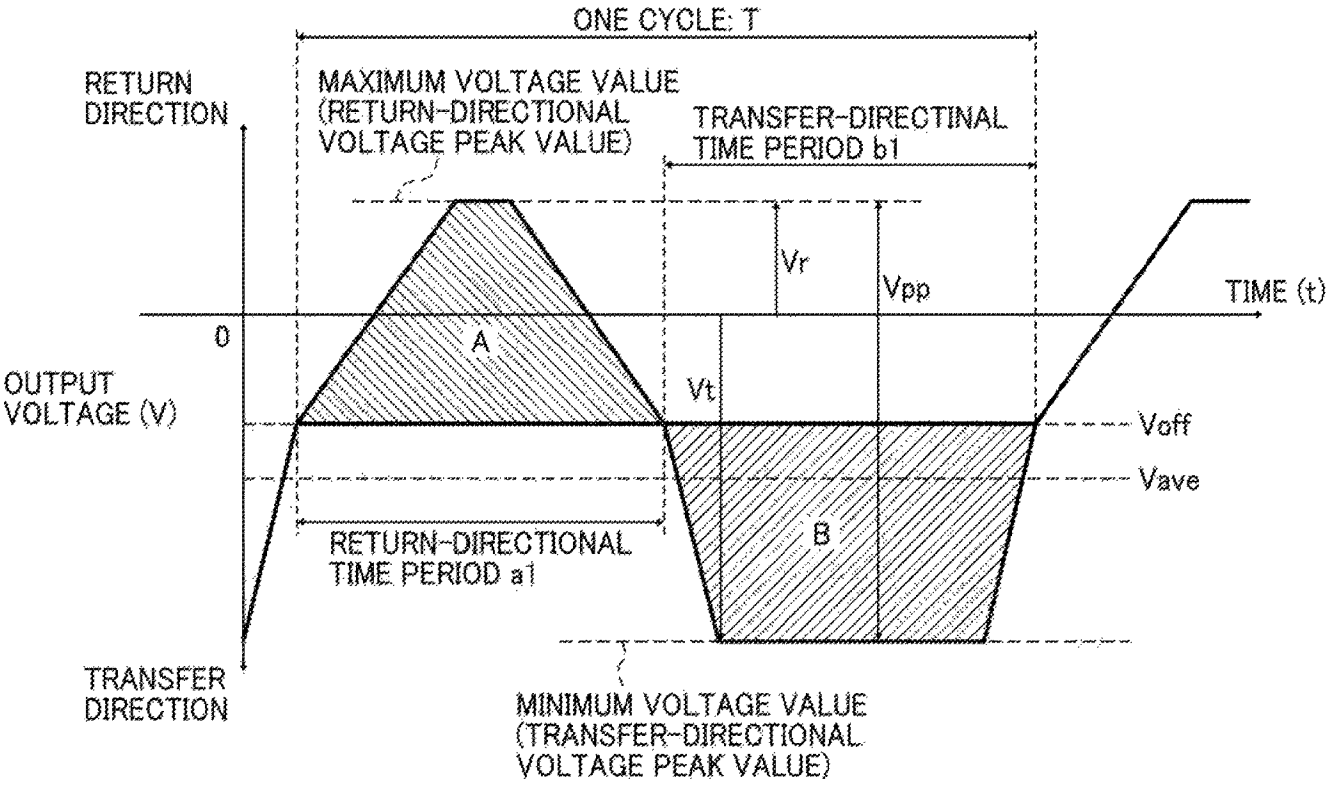
Figure 9:
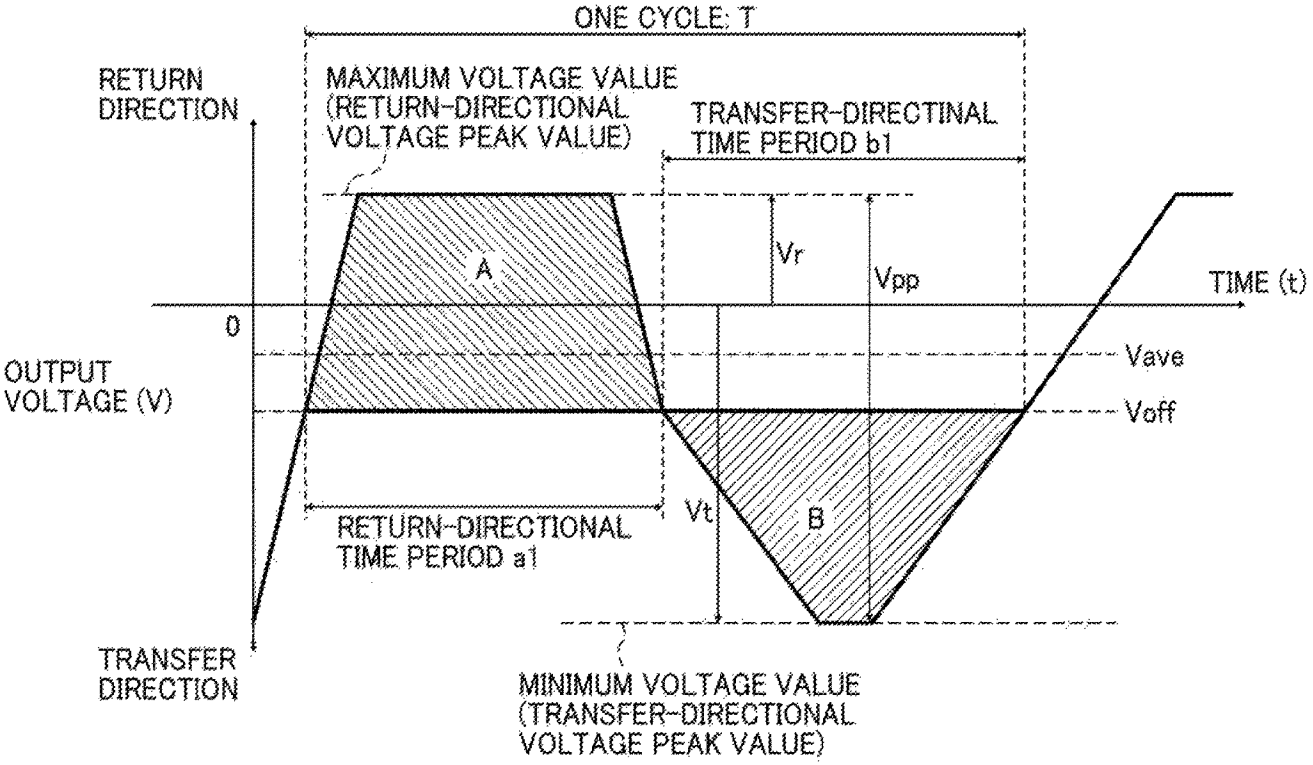
Figure 10:
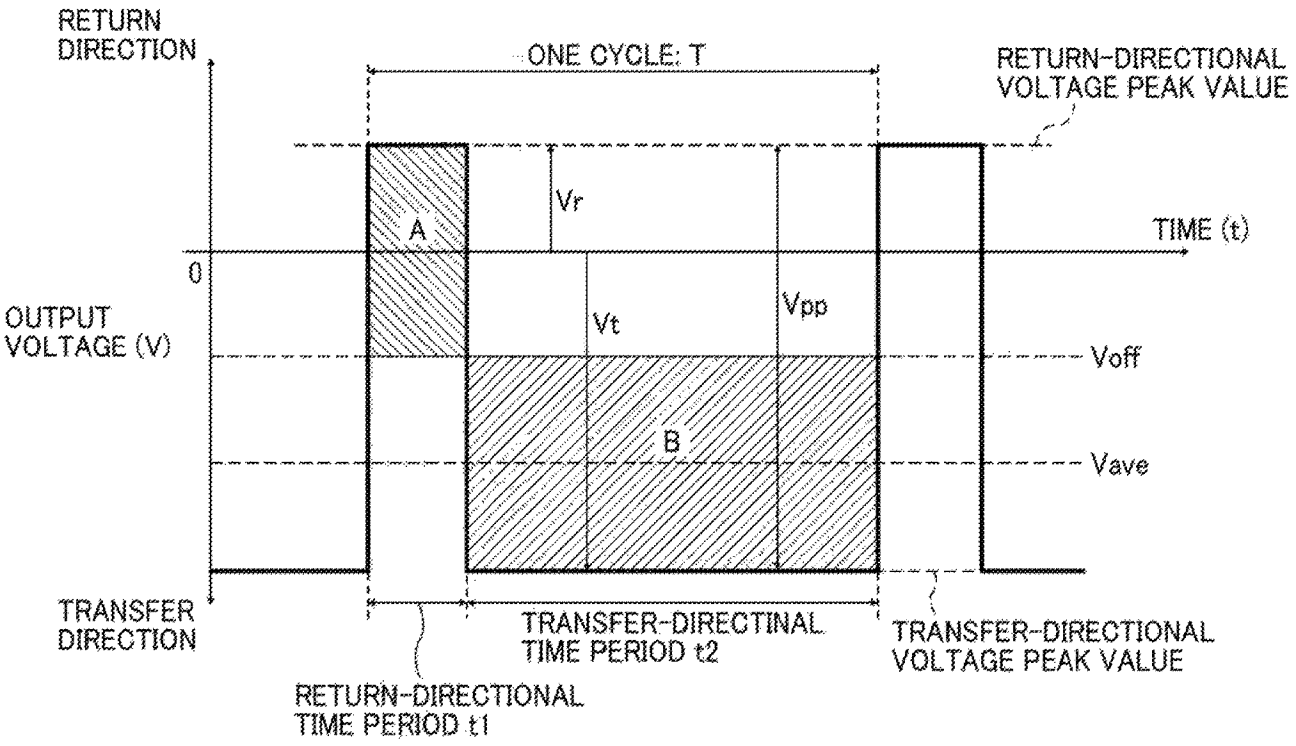
Figure 11:
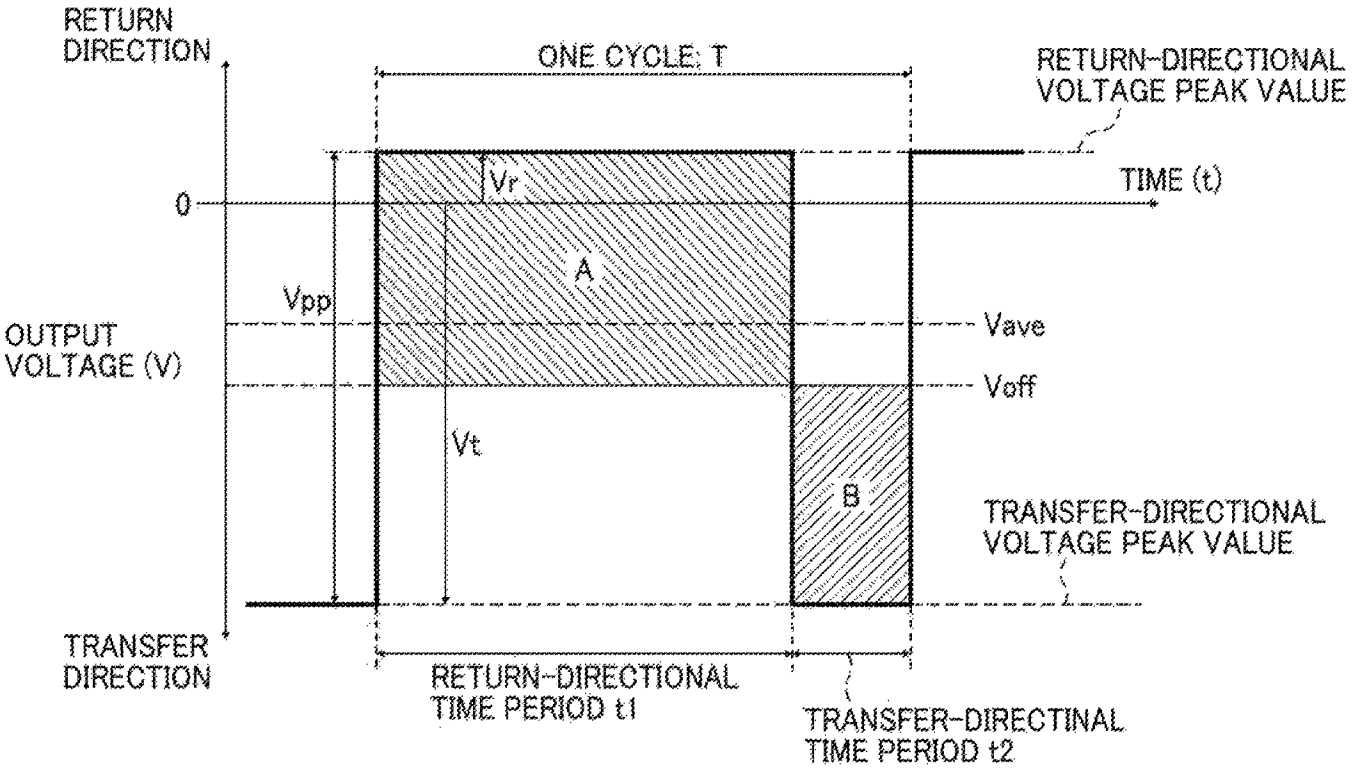

Each of FIGS. 4A and 4B is a circuit diagram of a secondary-transfer bias power source that switches between a direct current (DC) bias and a superimposed bias to be applied to a secondary-transfer unit;

FIG. 5 is a block diagram of an example configuration of the secondary-transfer bias power source that employs two relays to switch between the DC bias and the superimposed bias;

FIG. 6 is a block diagram of an example configuration of the secondary-transfer bias power source that switches between the DC bias and the superimposed bias without employing the two relays;

FIG. 7 is a waveform chart of the superimposed bias;

FIG. 8 is a waveform chart of the superimposed bias having low duty according to an embodiment of the present disclosure;

FIG. 9 is a waveform chart of the superimposed bias having high duty according to an embodiment of the present disclosure;

FIG. 10 is a waveform chart of the superimposed bias having low duty according to another embodiment of the present disclosure; and FIG. 11 is a waveform chart of the superimposed bias having high duty according to another embodiment of the present disclosure.

Figure 12:
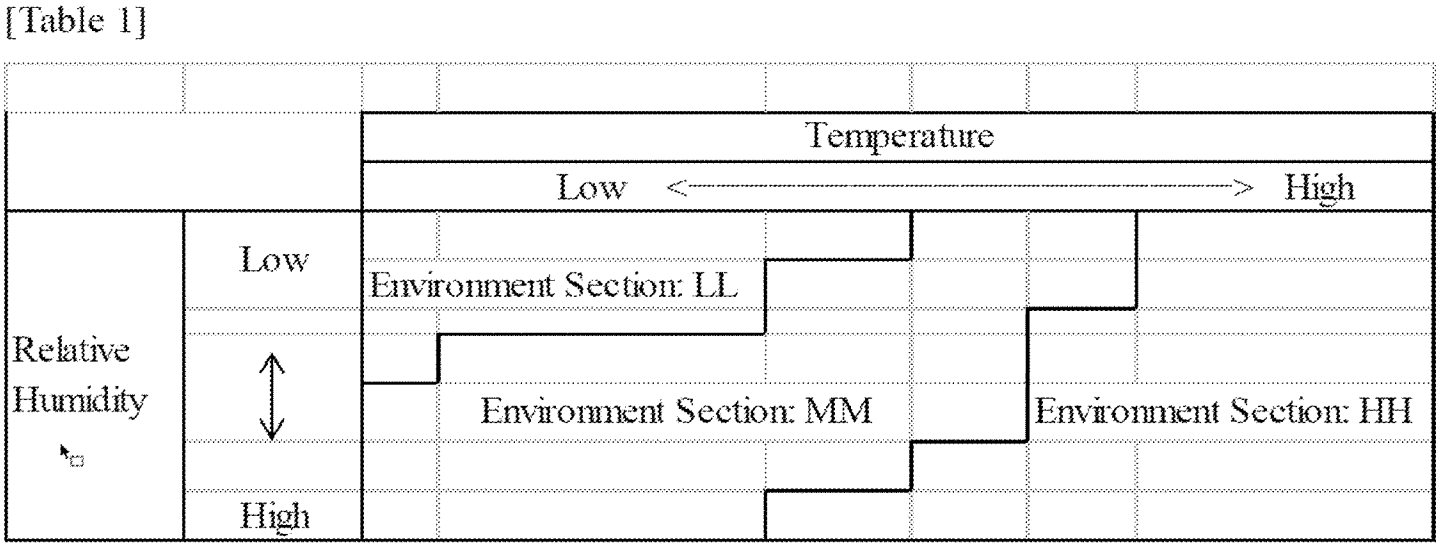

FIG. 12 is a table representing the environment sections determined according to the temperature and the relative humidity, as one example.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The following describes an electrophotographic color printer as an example of an image forming apparatus according to a first embodiment of the present disclosure. The various aspects of the present disclosure adapt to, not limited to a printer (an image forming apparatus), other types of image forming apparatuses, such as multicolor copiers, fax machines, and multifunction peripherals having the capabilities of the multicolor copiers and the fax machines.

The present inventors have found that a configuration, in which the alternating electrical field is generated to reciprocate toner in a transfer nip to transfer the toner into recesses of a recording sheet, has the following failures when the high-speed printing is attempted to respond to a demand for business users. Transferring a sufficient amount of toner onto recesses of a recording sheet having an uneven surface is difficult, and many white spots occurs in an image.

The following describes in detail the embodiments of the present disclosure, referring to the figures.

Figure 1:
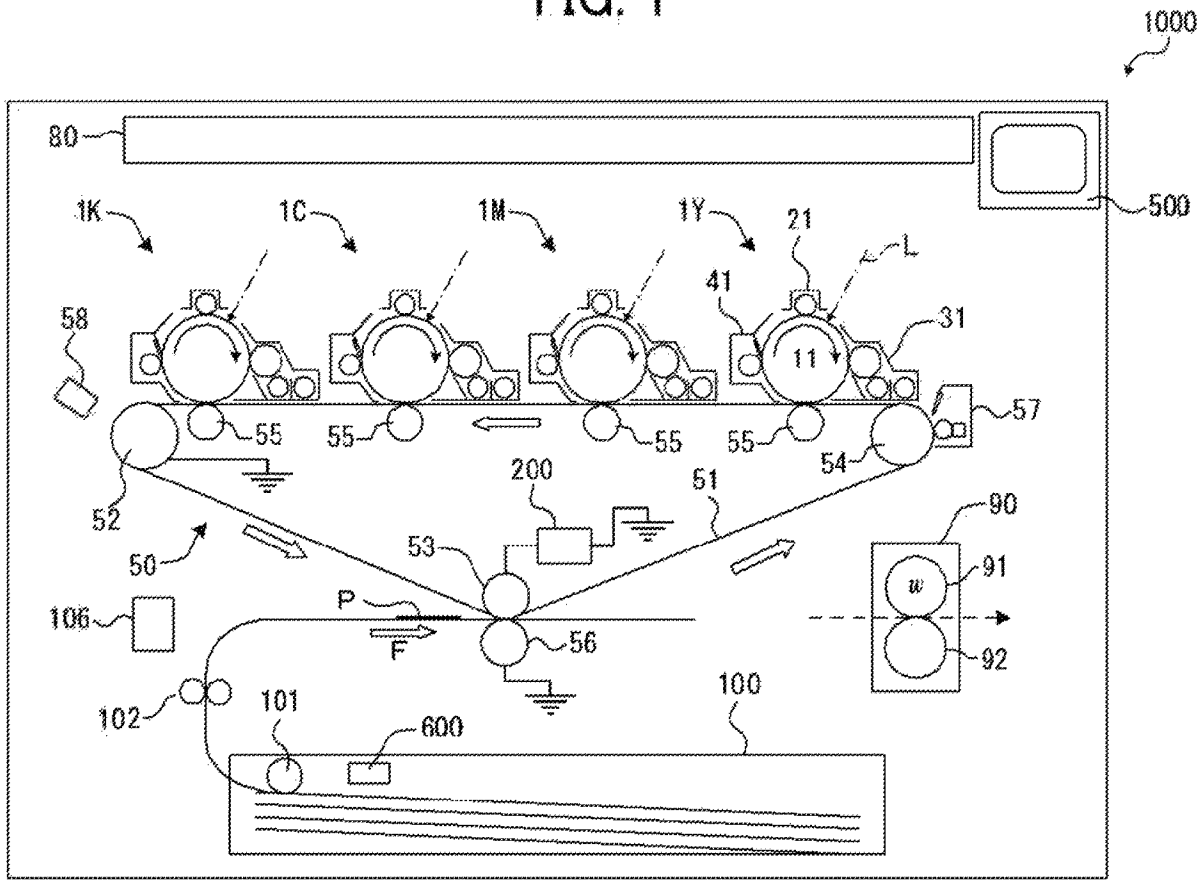
FIG. 1 is a schematic view of a configuration of a color printer as an example of an image forming apparatus according to an embodiment of the present disclosure.

FIG. 1 is a schematic view of a configuration of a color printer as an example of an electrophotographic image forming apparatus 1000 (hereinafter, referred to simply as "image forming apparatus") according to an embodiment of the present disclosure. The image forming apparatus 1000, which is a color image forming apparatus that adopts the intermediate transfer system, includes an endless belt (an intermediate transfer belt 51) as a transferor. In the image forming apparatus 1000, four image forming units 1Y, 1M, 1C, and 1K (hereinafter, referred to collectively as an image forming unit 1) for forming images of the colors yellow, magenta, cyan, and black are disposed along the upper belt course of the intermediate transfer belt 51. Each of the image forming units 1Y, 1M, 1C, and 1K constitutes a tandem image forming unit.

Figure 2:
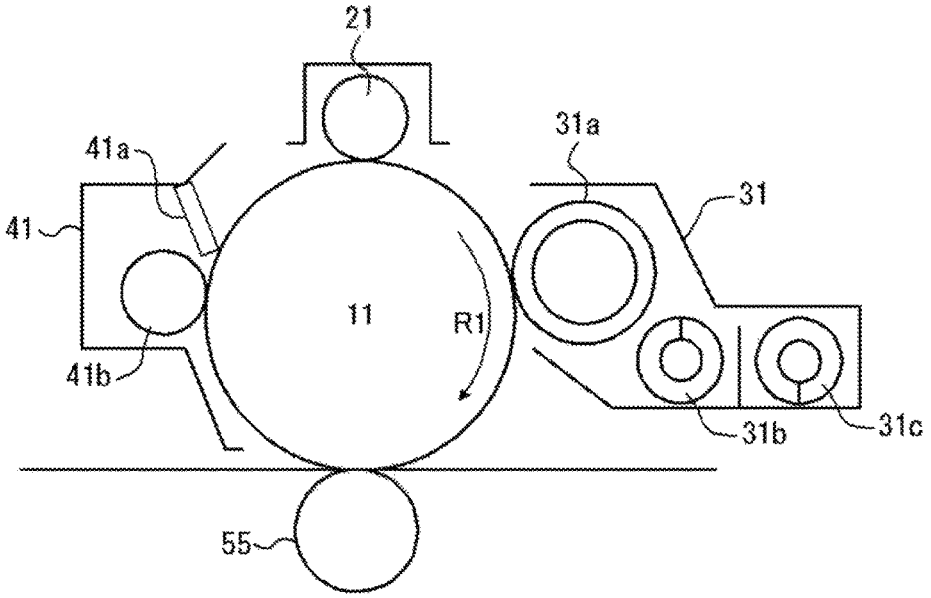
FIG. 2 is a schematic view of an image forming unit.

The image forming units 1Y, 1M, 1C, and 1K has the same configuration, except for different colors of toner employed. Referring to one of the image forming units 1Y, 1M, 1C, and 1K in FIG. 2, a description is given of the image forming units 1Y, 1M, 1C, and 1K. As illustrated in FIG. 2, the image forming unit 1 includes a photoconductor 11 as an image bearer, a charging device 21 to charge the surface of the photoconductor 11 with a charging roller, a developing device 31 to visualize a latent image on the photoconductor 11, a transfer roller 55 as a primary-transfer device to transfer a toner image from the photoconductor 11 onto an intermediate transfer belt 51, and a cleaning device 41 to clean the surface of the photoconductor 11. In the present embodiment, the image forming units 1Y, 1M, 1C, and 1K are detachably attached to an apparatus body.

The photoconductor 11 comprises a drum-shaped base on which an organic photosensitive layer is disposed, with the external diameter of approximately 60 mm. The photoconductor 11 is rotated in a clockwise direction by a drive device. The charging device 21 includes a charging roller to which a charging bias is applied. The charging roller contacts or is disposed in proximity to the photoconductor 11 to generate electrical discharge between the charging roller and the photoconductor 11, thereby charging uniformly the surface of the photoconductor 11. According to the present embodiment, the photoconductor 11 is uniformly charged with a negative polarity which is the same polarity as the normal charging polarity of toner. As a charging bias, a voltage, in which an alternating current (AC) voltage is superimposed on a direct current (DC) voltage, is employed. In some embodiments, a charger mat be employed instead of the charging roller.

The developing device 31 includes a developing sleeve 31*a* as a developer bearer and two screws 31*b* and 31*c* as agitators within a container that contains two-component developer of toner and carrier. The screws 31*b* and 31*c* convey the developer while agitating the developer. In some embodiments, a developing device that employs one-component developer may be adopted.

The cleaning device 41 includes a cleaning blade 41*a* and a cleaning brush 41*b*. The cleaning blade 41*a* is opposed to the photoconductor 11 from the opposite direction of the direction of rotation of the photoconductor 11 while contacting the photoconductor drum 11. The cleaning brush 41*b* cleans the surface of the photoconductor 11 while rotating in the opposite direction of the direction of rotation of the photoconductor 11 contacting the cleaning brush 41*b*.

In FIG. 1, the optical writing unit 80 for writing a latent image on the photoconductors 11 is disposed above the image forming units 1Y, 1M, 1C, and 1K. Based on image information provided by an external device, such as a personal computer (PC), the optical writing unit 80 illuminates the photoconductors 11Y, 11M, 11C, and 11K with the laser light projected from a laser diode of the optical writing unit 80. Accordingly, the electrostatic latent images of yellow, magenta, cyan, and black are formed on the photoconductors 11Y, 11M, 11C, and 11K, respectively. More specifically, the potential of the charged portion of the photoconductor 11 radiated with the light beam is attenuated. The potential of the irradiated portion of the photoconductor 2 with the light beam is less than the potential of the other area, that is, a background portion (non-image formation area), thereby forming an electrostatic latent image on the surface of the photoconductor 11. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 11Y. Alternatively, the optical writing unit 80 may employ a light source using an LED array including a plurality of LEDs that projects light.

Still referring to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearer formed into an endless loop and entrained about a plurality of rollers, thereby rotating endlessly in the counterclockwise direction indicated by hollow arrows. The transfer unit 50 also includes a drive roller 52, a secondary-transfer back surface roller 53, a cleaning backup roller 54, four primary transfer rollers 55Y, 55M, 55C, and 55K (which may be referred to collectively as primary transfer rollers 55), a nip forming roller 56 as a secondary transfer roller, a belt cleaning device 57, and a potential sensor 58.

The intermediate transfer belt 51 is looped around and stretched taut between the plurality of rollers, such as the drive roller 52, the secondary-transfer back surface roller 53, the cleaning backup roller 54, and four primary transfer rollers 55, and the intermediate transfer belt 51 endlessly rotates with the drive roller 52 that is driven by the drive device to rotate in the counterclockwise direction. The intermediate transfer belt 51 has the following characteristics. The intermediate transfer belt 51 has a thickness in a range of from 20 μm to 200 μm, preferably, approximately 60 μm. The volume resistivity of the intermediate transfer belt 51 ranges from 1.0×106 Ωcm through 1.0×1013 Ωcm, preferably from 1.0×107.5 Ωcm through 1.0×1012.5 Ωcm, and more preferably approximately 1.0×109 Ωcm. The volume resistivity is measured with an applied voltage of 100V by a high resistivity meter, Hiresta UPMCPHT 45 manufactured by Mitsubishi Chemical Corporation, with FRS probe. The material of the intermediate transfer belt 51 may be a single or multiple layers using polyvinylidene fluoride (PVDF), ethylene tetrafluoroethylene (ETFE) copolymer, polyimide (PI), and polycarbonate (PC). If necessary, a release layer may be additionally coated on top of the intermediate transfer belt 51. In some embodiments, the release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF). The intermediate transfer belt 51 may be manufactured by a method, such as the molding method or the centrifugal molding method. The surface of the intermediate transfer belt 51 may be polished, if necessary. In some embodiments, the belt material (endless belt) having a three-layer structure of a base layer, an elastic layer, and a coating layer may be used as the intermediate transfer belt 51. With the intermediate transfer belt 51 of the three-layer structure, the base layer is made of material in which non-extensible material, such as canvas, is combined with fluoro resin having less extensibility or rubber having a large extensibility. The elastic layer is made of, e.g., fluoro rubber or a copolymer rubber of acrylonitrile-butadiene, and formed on the base layer. The coating layer is formed by coating the surface of the elastic layer with, e.g., fluoro resin. Note that, conductive material, such as carbon black, is dispersed in the layer to adjust the volume resistivity.

The intermediate transfer belt 51 is interposed between the photoconductors 11Y, 11M, 11C, and 11K, and the primary transfer rollers 55Y, 55M, 55C, and 55K. Accordingly, primary transfer nips are formed between the outer peripheral surface or the image bearing surface of the intermediate transfer belt 51 and the photoconductors 11Y, 11M, 11C, and 11K that contact the intermediate transfer belt 51. A primary transfer bias is applied to the primary transfer rollers 55 by a transfer-bias power source to form a transfer electric field between toner images of the colors (yellow, magenta, cyan, and black) on the photoconductors 11Y, 11M, 11C, and 11K. Then, the transfer electric field and the nipping pressure primarily transfer the toner images from the photoconductor 11 onto the intermediate transfer belt 51. Accordingly, the toner images of the colors magenta, cyan, and black are sequentially superimposed on (primarily transferred onto) the yellow toner image, thus forming a four-color composite toner image on the intermediate transfer belt 51.

For monochrome imaging, a support plate supporting the primary transfer rollers 55Y, 55M, and 55C of the transfer unit 50 is moved to separate the primary transfer rollers 55Y, 55M, and 55C from the photoconductors 11Y, 11M, and 11C. Accordingly, the outer peripheral surface of the intermediate transfer belt 51, that is, the image bearing surface, is separated from the photoconductors 11Y, 11M, and 11C so that the intermediate transfer belt 51 contacts only the photoconductor 11K. In this state, only the image forming unit 1K is driven to form a black toner image on the photoconductor 11K.

Each primary transfer roller 55 is formed of an elastic roller including a metal cored bar on which a conductive sponge layer is disposed. The outer diameter of each primary transfer roller 55 is approximately 16 mm. The diameter of the metal cored bar is approximately 10 mm. The volume resistivity of the primary transfer roller 55 is determined by rotation measurement. Specifically, a weight of 5 newtons (N) is added for each side of the primary transfer roller 55, and a bias of 1 kilovolt (kV) is applied to the shaft of the primary transfer roller 55. The resistance value is obtained while the primary transfer roller 55 is caused to rotate for one minute at, e.g., 30 revolutions per minute (rpm). The average resistance value is determined as the volume resistivity. The resistance R obtained by Ohm's law (R=V/I) ranges from 1.0×106Ω to 1.0×109Ω, preferably about 3×107Ω. The primary transfer rollers 55Y, 55M, 55C, and 55K described above are supplied with a primary transfer bias under constant current control. According to the present embodiment described above, a roller-type transfer device (here, the primary transfer rollers 55) is used as a primary transfer device. Alternatively, a transfer charger or a brush-type transfer device may be employed as a primary transfer device.

As illustrated in FIG. 1, the nip forming roller 56 of the transfer unit 50 is disposed outside the loop formed by the intermediate transfer belt 51, opposite to the secondary-transfer back surface roller 53 which is disposed inside the loop. The intermediate transfer belt 51 is interposed between the secondary-transfer back surface roller 53 and the nip forming roller 56. Accordingly, a secondary transfer nip is formed between the peripheral surface or the image bearing surface of the intermediate transfer belt 51 and the nip forming roller 56 contacting the surface of the intermediate transfer belt 51. The nip forming roller 56 is grounded. By contrast, a secondary transfer bias is applied to the secondary-transfer back surface roller 53 by a secondary-transfer bias power source 200 (hereinafter, referred to simply as a power source 200 or a transfer-bias power source 200). With this configuration, a secondary-transfer electric field is formed between the secondary-transfer back surface roller 53 and the nip forming roller 56 so that the toner having a negative polarity is electrostatically transferred from the secondary-transfer back surface roller side to the nip forming roller side.

In the present embodiment, a temperature-humidity sensor 106 as an environment sensor is disposed to detect temperature and humidity around the secondary-transfer unit.

As illustrated in FIG. 1, a sheet tray 100 storing a sheaf of recording sheets P is disposed below the transfer unit 50. The sheet tray 100 is equipped with a feed roller 101 to contact the top sheet of the sheaf of recording sheets P. As the feed roller 101 rotates at a predetermined speed, the feed roller 101 picks up the top sheet of the recording sheets P and sends it to a feeding path. Substantially at the end of the feeding path, the pair of registration rollers 102 is disposed. The pair of the registration rollers 102 stops rotating temporarily as soon as the recording sheet P enters between the registration rollers 102. The pair of registration rollers 102 starts to rotate again to feed the recording sheet P to the secondary transfer nip in appropriate timing such that the recording sheet P is aligned with the composite toner image formed on the intermediate transfer belt 51 in the secondary transfer nip. In the secondary transfer nip, toner image on the intermediate transfer belt 51 in full contact the recording sheet P is secondarily transferred onto the recording sheet P by the effect of the secondary-transfer electric field and the nipping pressure. The recording medium P on which the composite color toner image or the monochrome toner image is formed passes through the secondary transfer nip and separates from the nip forming roller 56 and the intermediate transfer belt 51 due to the curvature of the rollers.

The secondary-transfer back surface roller 53 is constituted of a metal cored bar made of, for example, stainless steel and aluminum, and a resistance layer is laminated on the cored bar. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane. The volume resistivity of the resistance layer ranges from 106Ω to 1012Ω, more preferably ranges from 107 Ω to 109Ω. The resistance layer may be a foam-type layer having a hardness ranging from 20 degrees to 50 degrees or a rubber-type layer having a hardness ranging from 30 degrees to 60 degrees. Since the secondary-transfer back surface roller 53 contacts the nip forming roller 56 via the intermediate transfer belt 51, the resistance layer is preferably a sponge-type layer that allows the secondary-transfer back surface roller 53 to reliably contact the nip forming roller 56 via the intermediate transfer belt 51 even with a low contact pressure. As the contact pressure of the intermediate transfer belt 51 with the secondary-transfer back surface roller 53 is greater, characters and thin lines are more likely to drop out. Hence, the sponge-type layer can more reliably prevent such dropout.

The nip forming roller 56 is formed by a cored bar made of, for example, stainless steel and aluminum, having a resistance layer of a conductive rubber and a surface layer on the core metal. In the present embodiment, the nip forming roller 56 has an outer diameter of 20 mm, and the cored bar of the nip forming roller 56 is stainless steel, having a diameter of 16 mm. The resistance layer is copolymer rubber, such as nitrile rubber (NBR) or epichlorohydrin rubber (ECO), having a hardness ranging from 40 degrees to 60 degrees (Japanese Industrial Standards (JIS)-A). The surface layer, which is made of fluorine urethane elastomer, preferably has a thickness ranging from 8 to 24 micrometer (μm). This is because, with the surface layer of the nip forming roller 56, which is often manufactured by the coating process, having a thickness of less than or equal to 8 pun, the effects of unevenness in resistance due to variations in degree of coating increases, and thereby the possibility of the occurrence of electricity leakage undesirably increases in areas having the low resistance. Alternatively, with the surface layer having a thickness of less than or equal to 8 μm, the surface layer is more likely to crease, resulting in cracks of the surface layer. When the thickness of the surface layer is greater than or equal to 24 μm, the resistance of the surface layer increases. When the nip forming roller 56 has a relatively high volume resistivity, the cored bar of the secondary-transfer back surface roller 53 might increase in voltage applied under constant-current control, and thereby the voltage exceeds the voltage-variable range of the constant-current power source, resulting in current of less than or equal to target current value. Even with a sufficiently wide voltage-variable range, the electricity leakage is more likely to occur due to an increase in voltage in the high-pressure route between the constant-current power source and the cored bar of the secondary-transfer back surface roller 53 or due to an increase in voltage in the cored bar of the secondary-transfer back surface roller 53. Further, with the surface layer having a thickness of greater than or equal to 24 μm, the surface layer increases in hardness, thereby undesirably reducing the contact between the recording medium (paper sheets) and the intermediate transfer belt 51. The surface resistivity of the nip forming roller is greater than or equal to 106.5Ω, and the volume resistivity of the surface of the nip forming roller 56 is greater than or equal to 1010 Ωcm and more preferably greater than or equal to 1012 Ωcm.

In some embodiments, the nip forming roller 56 may be a foamed roller without the surface layer. Such a foamed roller as the nip forming roller 56 has a volume resistivity ranging from 6.0 log Ω to 8.0 log Ω, and preferably from 7.0 log Ω to 8.0 log Ω. In this case, the secondary-transfer back surface roller 53 may be a foamed roller, a rubber roller, or a metal roller made of stainless steel (SUS), having a volume resistivity of less than or equal to 6.0 log Ω that is lower than the volume resistivity of the nip forming roller 56. The volume reactivities of the nip forming roller 56 and the secondary-transfer back surface roller 53 are respectively determined by rotation measurement the same as in the above-described primary transfer roller 55. Specifically, a weight of 5 newtons (N) is added for each side of the primary transfer roller 55, and a bias of 1 kilovolt (kV) is applied to the shaft of the primary transfer roller 55. The resistance value is obtained while the primary transfer roller 55 is caused to rotate for one minute at, e.g., 30 revolutions per minute (rpm). Then, the average resistance value is determined as the volume resistivity.

The potential sensor 58 is disposed outside the loop formed by the intermediate transfer belt 51. More specifically, out of the entire range of the intermediate transfer belt 51 in the circumferential direction (in a shape of arc), the potential sensor 58 faces a portion of the intermediate transfer belt 51 entrained around the drive roller 52, which is grounded, across a gap of approximately 4 mm from the intermediate transfer belt 51. When the toner image primarily transferred on the intermediate transfer belt 51 arrives at the position opposed to the potential sensor 58, the potential sensor 58 measures the surface potential of the toner image. In the present embodiment, a surface potential sensor EFS-22D manufactured by TDK Corp. is employed as the potential sensor 58. In some embodiments, the potential sensor may be a toner-image sensor. The toner image sensor is an optical sensor to detect the amount of toner image primarily transferred onto the intermediate transfer belt 51 by converting the output of received light into the amount of toner adhering to the intermediate transfer belt 51 (hereinafter, referred to also as the amount of adhesion of toner).

On the right hand side of the secondary transfer nip between the secondary-transfer back surface roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing nip at which the surface of the recording medium P bearing the unfixed toner image tightly contacts the fixing roller 91 in the fixing device 90. Under heat and pressure, the toner adhered to the toner image is softened and fixed to the recording medium P in the fixing nip. After the toner image is affixed to the recording medium P, the recording medium P is output from the fixing device 90. Subsequently, the recording medium P is delivered outside the image forming apparatus 1000 via a post-fixing medium path.

Figure 3:
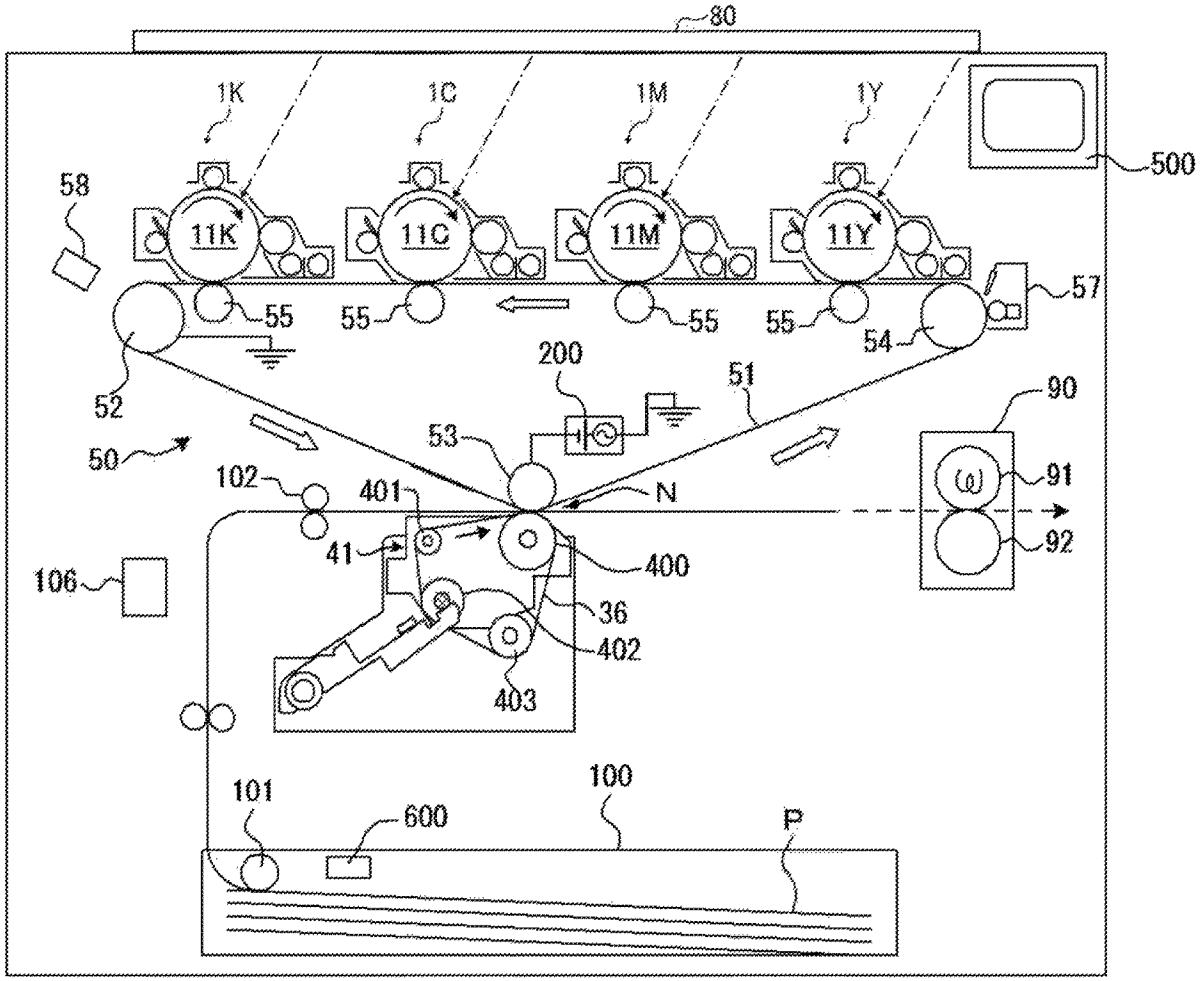
FIG. 3 is a schematic view of a configuration of an image forming apparatus according to another embodiment of the present disclosure.

In some embodiments, the configuration as illustrated in FIG. 3 that employs a secondary-transfer unit 41 including an endless secondary-transfer belt 36 may be adopted. The secondary-transfer unit 41 in FIG. 3 includes the secondary-transfer belt 36, a secondary-transfer roller 400, and support rollers 401, 402, and 403. The secondary-transfer belt 36 is supported by the secondary-transfer roller 400 and support rollers 401, 402, and 403. The secondary-transfer roller 400 is electrically grounded. The secondary-transfer belt 36 and the intermediate transfer belt 51 forms a secondary-transfer nip N therebetween.

In the image forming apparatus according to the present embodiment, the secondary-transfer bias power source 200 is constituted by a direct current (DC) power source 201 (a superimposed-voltage power source) to output a DC component and an alternating voltage (AC) power source 202 to output a voltage in which an AC component is superimposed on the DC component. That is, the secondary-transfer bias power source 200 outputs the DC voltage (hereinafter, referred to as DC bias) and a voltage (hereinafter, referred to as superimposed bias), in which the AC voltage is superimposed on the DC voltage, as the secondary-transfer bias.

Each of FIGS. 4A and 4B is a circuit diagram of the secondary-transfer bias power source that switches between a direct current (DC) bias and the superimposed bias to be applied to a secondary-transfer unit (the secondary-transfer back surface roller 53). In FIGS. 4A and 4B, the secondary-transfer bias power source 200 includes the DC power source 201 and the AC power source (superimposed power source) 202.

In FIG. 4A, the DC power source 201 applies the DC bias to the secondary-transfer back surface roller 53. In FIG. 4B, the AC power source 202 applies the superimposed bias to the secondary-transfer back surface roller 53. The secondary-transfer bias power source 200 in FIGS. 4A and 4B switches between the DC power source 201 and the AC power source 202, using a switch. In a specific configuration example as illustrated in FIG. 5, the secondary-transfer bias power source 200 employs two relays, i.e., a first relay and a second relay, to switch between the DC power source 201 and the AC power source 202. As illustrated in FIG. 6 for another example, the configuration without any switching unit is also available.

FIG. 5 is a block diagram of an example configuration of the secondary-transfer bias power source 200 that employs the first relay and the second relay to switch between the DC bias and the superimposed bias. As illustrated in FIG. 5, the DC power source 201 applies the DC bias to the secondary-transfer back surface roller 53 via the first relay. Further, the AC power source 202 applies the superimposed bias to the secondary-transfer back surface roller 53 via the second relay. As illustrated in FIG. 5, a controller 300 controls the connection and cutoff of each of the first relay and the second relay via a relay driver 205. The DC power source 201 includes a detector 203 to detect a feedback voltage and input the detected feedback voltage to the controller 300.

FIG. 6 is an illustration of an example configuration that switches between the DC bias and the AC bias without using any relay. As illustrated in FIG. 6, the bias power source 200 includes a direct current (DC) power source 201 and an alternating current (AC) power source 202*a*. The AC power source 202 applies the AC bias to the secondary-transfer back surface roller 53. The DC power source 201 applies the DC bias to the secondary-transfer back surface roller 53 through the AC power source 202*a*. When the secondary-transfer bias power source 200 applies the DC bias to the secondary-transfer back surface roller 53, the controller 300 controls the DC power source 201 to output the DC bias with the AC power source 202*a* turned off. When the secondary-transfer bias power source 200 applies the superimposed bias to the secondary-transfer back surface roller 53, the controller 300 controls the DC power source 201 to output the DC bias while controlling the AC power source 202*a* to output the AC bias. Thus, the secondary-transfer bias power source 200 applies the superimposed bias, in which the AC bias is superimposed on the DC bias, to the secondary-transfer back surface roller 53. The controller 300 controls switching between the DC bias and the superimposed bias. The DC power source 201 includes the detector 203 to detect a feedback voltage and input the detected feedback voltage to the controller 300.

The configuration of the secondary-transfer bias power source 200 and the manner in which voltage is supplied are not limited to the present embodiments, and various configurations are available as described later.

Next, a description is given of the application of the superimposed bias, referring to the waveform chart in FIG. 7.

In FIG. 7, an offset voltage Voff is a value of the DC component of the superimposed bias. A peak-to-peak voltage Vpp is a peak-to-peak voltage of the AC component of the superimposed bias. According to the present embodiment, the superimposed bias is a voltage, in which the offset voltage Voff and the peak-to-peak voltage Vpp are superimposed on each other. Thus, the time-averaged value of the superimposed bias is the same as the offset voltage Voff. As illustrated in FIG. 7, the waveform of the superimposed bias has a sinusoidal shape having peak values on the positive side and the negative side, respectively. The symbol "Vt" in FIG. 7 refers to the peak value on the negative side to move toner from the intermediate transfer belt 51 onto the recording sheet P within the secondary transfer nip N. The symbol "Vr" in FIG. 7 refers to the peak value on the positive side to move the toner from the recording sheet P back to the intermediate transfer belt 51. The superimposed bias including the DC voltage is applied to allow the offset voltage Voff, which is the time-averaged value, to have the same polarity as the polarity of toner (negative polarity in the present embodiment), thereby causing the toner to reciprocally move between the intermediate transfer belt 51 and the recording sheet P, thus relatively transferring the toner from the intermediate transfer belt 51 onto the recording sheet P. According to the present embodiment, an AC voltage having a sine wave is used. Alternatively, in some embodiments, an AC voltage having a square wave may be used.

The waveform in FIG. 7 is symmetrical. However, no limitation is intended thereby, and another waveform, in which a time period for moving toner from the intermediate transfer belt 51 to the recording sheet P is different from a time period for moving the toner from the recording sheet P back to the intermediate transfer belt 51, may be used for the AC component. In the present embodiment, the waveform, in which a time period for moving toner from the intermediate transfer belt 51 to the recording sheet P is different from a time period for moving the toner from the recording sheet P back to the intermediate transfer belt 51, is adopted.

The following describes duty in the superimposed bias, in which the AC voltage (i.e., the peak-to-peak voltage Vpp) is superimposed on the DC voltage (i.e., the time-average value Vave), referring to FIGS. 8 and 9. Note that the transfer operation using the superimposed bias (superimposed voltage) is referred to as an "AC transfer".

The ratio of an area on the return-directional side relative to the midpoint voltage value Voff, to the entire area of the AC waveform is defined as a return-directional time period (%) that represents the relation of the midpoint voltage value Voff and the time-averaged value Vave in the superimposed bias. That is, when A denotes the area on the return-directional side relative to the midpoint voltage value (Voff) and B denotes the area on the transfer-directional side relative to the midpoint voltage value (Voff) in one cycle of the waveform of the voltage that alternately changes, the duty is defined by the formula of "A/(A+B)×100%".

In other words, the duty refers to the ratio in time period for voltage output between the transfer direction and the return direction (the opposite-polarity side) relative to the midpoint voltage value (Voff) within the one cycle of the waveform of the voltage that alternately changes.

FIG. 8 is a waveform chart in which the duty is 50%, and FIG. 9 is a waveform chart in which the duty is greater than 50%. In the present disclosure, the duty of less than 50% is a low duty, and the duty of greater than 50% is a high duty.

In a low-duty AC transfer mode as a first mode, in which the superimposed bias with the low duty is employed, the time-average value (Vave) in the AC component of the secondary-transfer bias is on the transfer side relative to the midpoint voltage value (the center value of the maximum value and the minimum value of the secondary-transfer voltage) Voff. To achieve such a relation of the values of Vave and Voff, the area on the return-directional side has a smaller waveform than the area on the transfer-directional side with respect to the midpoint voltage value Voff of the AC component. The time-averaged value Vave of the voltage refers to a value obtained by dividing the sum of the voltage wavelengths in the one cycle by the length of time for the one cycle.

According to an embodiment that achieves the above-described configuration, a trapezoidal waveform as illustrated in FIG. 8 for example is conceivable in which the inclinations of the rising waveform and the falling waveform of the voltage in the return direction (return-directional voltage) are made smaller than the inclinations of the rising waveform and the falling waveform of the voltage in the transfer direction (transfer-directional voltage).

Alternatively, in some embodiments, the embodiment of the waveform is not limited to the trapezoidal waveform, and may be a triangle waveform, a rectangular waveform, or the combination thereof.

According to another embodiment that achieves the low-duty waveform, a waveform as illustrated in FIG. 10 for example may be used. With the waveform as illustrated in FIG. 10, the low duty is obtained by adjusting the time period in the return direction (return-directional time period) and the time period in the transfer direction (transfer-directional time period). More specifically, the symbol "T" is a cycle of the secondary-transfer bias, the symbol "t1" is the return-directional time period, and the symbol "t2" is the transfer-directional time period in FIG. 10. In FIG. 10 for example, t1 is less than t2 (i.e., $t1<t2$), and the area A on the return-directional side is smaller than the area B on the transfer-directional side. That is, the duty, which is obtained by the formula of "A/(A+B)×100%", is the low duty having duty of less than or equal to 50%.

When a recording sheet P having a high degree of surface unevenness (i.e., the degree of surface unevenness is greater than a predetermined value), such as Japanese paper or paper having an embossed surface, is used, the superimposed bias having the low duty as illustrated in FIGS. 8 and 10 is applied to reciprocally move toner between the intermediate transfer belt 51 and the recording sheet P, thus relatively transferring the toner from the intermediate transfer belt 51 onto the recording sheet P. This allows for an increase in transferability of toner onto the recesses of the recording sheet P, thus increasing the transfer rate and preventing or reducing the occurrence of image failure, such as toner dropout. Note that the "sheet having a high degree of surface unevenness" refers to paper sheets, such as Leathac, embossed paper and linen paper, having an uneven surface with a maximum depth of greater than or equal to 60 μm.

Preferably, the superimposed bias having the low duty alternately change the bias polarity between a polarity (the negative polarity in the present embodiment) to transfer a toner image to a recording sheet P and an opposite polarity (the positive polarity in the present embodiment) of the polarity. With such a bias employed, toner electrostatically moves between the intermediate transfer belt 51 and the surface of the recording sheet P (particularly, the recesses in the surface) in a reciprocative manner, which increases the transferability of toner onto the recesses of the recording sheet P. Applying the superimposed bias having the low duty is more effective in the following two advantageous effects as compared to the case, in which the superimposed bias has the duty of 50% or has the high duty: (i) the transfer-directional voltage peak value (Vt) can be reduced; and (ii) the absolute value of the time-average voltage (Vave) can be increased while increasing the return-directional peak value (Vr). This can prevent the occurrence of electric discharge due to the excessive increase in the transfer-directional voltage peak value (Vt). Further, an appropriate (increased) return-directional peak value (Vr) allows a sufficient amount of toner to reciprocally move.

Increasing the absolute value of the time-average voltage (Vave) allows the sufficient degree of the toner image to be transferred onto the recording sheet P.

In a high-duty AC return mode as a second mode, in which the superimposed bias with the high duty is employed, the time-average value (Vave) in the AC component of the secondary-transfer bias is on the return-direction side relative to the midpoint voltage value (the center value of the maximum value and the minimum value of the secondary-transfer voltage). To achieve such a relation of the values of Vave and Voff, the area on the return-directional side has a larger waveform than the area on the transfer-directional side relative to the midpoint voltage value Voff of the AC component.

According to an embodiment that achieves the above-described configuration, a trapezoidal waveform as illustrated in FIG. 9 for example is conceivable in which the inclinations of the rising waveform and the falling waveform of the voltage in the return direction (return-directional voltage) are greater than the inclinations of the rising waveform and the falling waveform of the voltage in the transfer direction (transfer-directional voltage).

Alternatively, in some embodiments, the embodiment of the waveform is not limited to the trapezoidal waveform, and may be a triangle waveform, a rectangular waveform, or the combination thereof.

According to another embodiment that achieves the high-duty waveform, a waveform as illustrated in FIG. 11 for example may be used. With the waveform as illustrated in FIG. 11, the high duty is obtained by adjusting the time period in the return direction (return-directional time period) and the time period in the transfer direction (transfer-directional time period). More specifically, the symbol "T" is a cycle of the secondary-transfer bias, the symbol "t1" is the return-directional time period, and the symbol "t2" is the transfer-directional time period in FIG. 11. In FIG. 11 for example, t1 is greater than t2 (i.e., t1>t2), and the area A on the return-directional side is greater than the area B on the transfer-directional side. That is, the duty, which is obtained by the formula of "A/(A+B)×100%", is the high duty having duty of greater than 50%.

Applying the superimposed bias having the high duty as illustrated in FIGS. 9 and 11 reduces the amount of electric charge in the transfer direction, thereby preventing a reduction in amount of charged toner mass-to-charge ratio (Q/M) due to charge injection within the secondary-transfer nip N. Accordingly, the insufficient image density due to the reduction in secondary transferability caused by the reduction in the amount of charged toner Q/M can be prevented. The following configuration allows for a successful secondary transfer of a toner image even with the duty of greater than 50%. Reducing the area on the positive side with respect to the reference of 0 V in the graph to be smaller than the area on the negative side to obtain the average potential having the negative polarity, so that the toner relatively moves from the intermediate transfer belt 51 to the recording sheet P in an electrostatical manner.

The superimposed bias having the high duty alternately changes the bias polarity between a polarity (the negative polarity in the present embodiment) to transfer a toner image to a recording sheet P and an opposite polarity (the positive polarity in the present embodiment) of the polarity. Alternatively, the superimposed bias may not reverse the bias polarity (i.e., the bias polarity remains negative in the present embodiments). In any case, the insufficient image density due to the reduction in secondary transferability caused by the reduction in the amount of charged toner Q/M can be prevented in a greater manner than the case, in which the transfer bias having only the DC component, i.e., the transfer bias maintaining a high voltage on the negative-polarity side.

In the present embodiment, the AC transfer mode that employs the superimposed bias includes the low-duty AC transfer mode as illustrated in FIGS. 8 and 10, in which the duty is less than or equal to 50%, and the high-duty AC transfer mode as illustrated in FIGS. 9 and 11, in which the duty is greater than 50%. The image forming apparatus 1000 according to the present embodiment alternately changes the transfer mode between the low-duty AC transfer mode and the high-duty AC transfer mode. More specifically, the image forming apparatus 1000 according to the present embodiment changes the transfer mode between the low-duty AC transfer mode and the high-duty AC transfer mode according to the type of sheet to pass through the secondary-transfer nip N.

Alternatively, in some embodiments, the forming apparatus 1000 according to the present embodiment may change the transfer mode between the low-duty AC transfer mode, the high-duty AC transfer mode, and the DC transfer mode according to the type of sheet to pass through the secondary-transfer nip N or predetermined conditions, such as temperature and humidity. The image forming apparatus 1000 as illustrated in FIGS. 1 and 3 includes an optical sensor 600 opposed to the sheet tray 100. The optical sensor 600 includes a light-emitting unit, a light-receiving unit, and a determination unit. The light-emitting unit emits light toward the surface of the sheet disposed on the sheet tray 100. The light-receiving unit receives light reflected from the surface of the sheet. The determination unit determines the unevenness of the surface of the sheet based on the shape (profile curve) of the surface of the sheet, the shape being detected by the light-emitting unit and the light-receiving unit. The optical sensor 600 emits light to an area with a predetermined length (e.g., 20 millimeters (mm)) in the sheet disposed in the sheet tray 100 and receives the light reflected by the area to determine the shape (profile curve) of the surface of the sheet. Then, the determination unit obtains a maximum profile height Pt (JISB0601: 2001) of the profile curve. In the present embodiment, the maximum profile height Pt (μm) is defined as the surface unevenness of a sheet. The image forming apparatus 1000 according to the present embodiment changes the transfer mode according to information, i.e., the surface unevenness of the recording sheet P determined by the determination unit of the optical sensor 600. With a surface unevenness of greater than or equal to a predetermined value, the image forming apparatus 1000 selects the low-duty AC transfer mode. With a surface unevenness of less than the predetermined value, the image forming apparatus 1000 selects the high-duty AC transfer mode. Note that the image forming apparatus 1000 may automatically change the transfer mode according to the type of the set recording sheet P (i.e., according to whether the recording sheet P is an uneven-surface sheet or not).

Alternatively, in some embodiments, the image forming apparatus 1000 may allow a user to select the transfer mode. In this case, an operation panel 500 as an operation unit disposed on the top of the image forming apparatus 1000 (refer to FIGS. 1 and 3) allows a user to set the transfer mode. When a user selects the transfer mode using the operation panel 500, the operation panel 500 preferably includes, for example, a "recesses priority mode" and a "halftone image priority mode" to allow for the user's selection. With the recesses priority mode, the controller 300 controls the power source 200 to transfer an image onto a recording sheet P in the low-duty AC transfer mode. With the halftone image priority mode, the controller 300 controls the power source 200 to transfer an image onto a recording sheet P in the high-duty AC transfer mode.

That is, the image forming apparatus 1000 according to the present embodiment includes the operation panel 500 to select between the recesses priority mode to transfer a toner image from the intermediate transfer belt 51 onto a recording sheet P using the bias with the duty of less than 50% and the halftone image priority mode to transfer a toner image from the intermediate transfer belt 51 onto a recording sheet P using the bias with the duty of greater than 50%. The controller 300 controls the power source 200 to output the bias with the duty of less than 50% or the bias with the duty of greater than 50% according to the mode selected by a user via the operation panel 500.

Some sheets have surface recesses irrespective of the type of recording sheets. Some images include halftone images irrespective of the type of recording sheets. In transferring an image onto an arbitrary type of sheet, the image forming apparatus 1000 according to the present embodiment allows a user to select the transfer mode according to whether the transferability in recesses of a sheet or the transferability of a halftone image is prioritized, using the operation panel 500. The controller 300 outputs the superimposed bias according to the mode selected by the user, thus outputting an image that responds to a user's need in a simplified manner.

In some embodiments, the image forming apparatus 1000 may allow a user to select the type of recording sheet using the operation panel 500. Then, the controller 300 controls the secondary-transfer bias power source 200 to output the bias with the duty of less than 50% or the bias with the duty of greater than 50% according to the recording sheet P selected by a user via the operation panel 500. When the recording sheet P selected by user has a surface unevenness of greater than or equal to a predetermined value, the controller 300 selects the low-duty AC transfer mode. When the recording sheet P selected by user has a surface unevenness of less than the predetermined value, the controller 300 selects the high-duty AC transfer mode. Such a configuration also allows outputting an image responding to a user's need in a simplified manner. In some embodiments, the configuration to select the type of recording sheet P via the operation panel 500 may be a configuration that allows directly selecting the brand of a recording sheet P or a configuration that allows selecting whether a recording sheet P is an uneven surface sheet.

In the secondary-transfer unit in FIG. 1 according to the present embodiment, the secondary-transfer bias power source 200 applies the superimposed bias, in which the AC component is superimposed on the DC component, to the secondary-transfer back surface roller 53. Alternatively, in some embodiments, the secondary-transfer bias power source 200 may apply one of the DC bias and the AC bias to the secondary-transfer back surface roller 53 and apply the other bias to the nip forming roller 56. Alternatively, the secondary-transfer bias power source 200 may apply the superimposed bias, in which the AC component is superimposed on the DC component, to the nip forming roller 56. In the secondary-transfer unit in FIG. 3, the secondary-transfer bias power source 200 applies the secondary-transfer bias to the secondary-transfer back surface roller 53. Alternatively, is some embodiments, the secondary-transfer bias power source 200 may apply the secondary-transfer bias to the secondary-transfer roller 400. In the above-described cases, the polarities of employed toner and applied bias are appropriately adjusted according to the configuration. Note that when using a recording sheet P having a small degree of surface unevenness, such as plain paper, the transfer bias including only of the DC component may be applied. By contrast, when using a recording sheet P having a large degree of surface unevenness, the secondary-transfer bias power source 200 preferably change the transfer bias from the bias including only the DC component to the superimposed bias.

Next, a detailed description is given of the secondary-transfer bias. Note that in the present embodiment (Example 1), the DC component of the secondary-transfer bias is under constant current control, and the peak-to-peak voltage of the AC component of the secondary-transfer bias is under constant voltage control.

In the configuration as illustrated in FIG. 5, an AC-DC superimposing power source 202 includes a DC output unit to output the DC component and an AC output unit to output the AC component. The DC output unit outputs the time-average voltage (Vave) as the DC component. The AC output unit outputs the AC voltage. The AC-DC superimposing power source 202 superimposes the AC voltage on time-average voltage Vave to generate the superimposed bias as illustrated in FIGS. 7 through 11 and applies the generated superimposed bias to the secondary-transfer unit.

In the configuration as illustrated in FIG. 6, the DC power source 201 outputs the time-average voltage (Vave) as the DC component. The AC power source 202 outputs the AC voltage. The secondary-transfer bias power source 200 superimposes the AC voltage on time-average voltage Vave to generate the superimposed bias as illustrated in FIGS. 7 through 11 and applies the generated superimposed bias to the secondary-transfer unit.

Hereinafter, the time-average voltage is defined as the DC component, and the AC voltage superimposed on the time-time-average voltage is defined as the AC component.

The respective values of the DC component and the AC component of the superimposed bias are determined by combining the environmental correction according to the environmental conditions for the apparatus, the linear speed correction according to the printing speed of the image forming apparatus 1000, the sheet-size correction according to the sheet conditions. i.e., the correction according to the main-scanning directional width and thickness of a sheet, and the correction according to the resistance of the transfer unit, relative to the standard values of the DC component and the AC component.

The present inventors have found that when a sheet having a smooth surface, such as plain paper or coated paper, is used relative to an elastic belt having a multilayer structure as the image bearer (the intermediate transfer belt 51) bearing a toner image, the insufficient image density due to the secondary-transfer failure is more likely to occur. With respect to such a secondary-transfer failure, the present inventors have recognized the following. The intermediate transfer belt 51 is interposed between a back surface roller (the secondary-transfer back surface roller 53) and a contact roller (the nip forming roller 56 or the secondary-transfer roller 400) at the secondary-transfer nip N, and a secondary transfer current flows between the contact roller and the back surface roller. When using a multilayer intermediate transfer belt, the secondary transfer current flows in a thickness direction of the intermediate transfer belt along the circumferential direction of the intermediate transfer belt, in the boundary between the layers. As a result, at the secondary transfer nip N, the secondary transfer current flows not only to the center of the secondary transfer nip, at which the nip pressure is the highest, but also to the nip start portion and to the nip end portion. This means that the secondary transfer current flows into the toner image on the intermediate transfer belt within the secondary transfer nip for an extended period of time. Consequently, it has been found that a significant amount of charges having a polarity opposite to the charge polarity of toner are injected to the toner, resulting in a decrease in the amount of charged toner Q/M when the toner has a normal polarity. In other words, the secondary transferability is degraded, causing insufficient image density.

The present inventors have found that outputting the secondary-transfer bias with the duty of greater than 50% can prevent the reduction in the amount of charged toner Q/M due to the injection of the charges having the opposite polarity into toner in the secondary-transfer nip N, and further allows for a successful secondary transfer of a toner image, thus preventing the occurrence of insufficient image density.

However, applying the secondary-transfer bias with the high duty exhibits the above-described effects when the peak-to-peak value of the AC voltage and the time-average voltage of the transfer bias are increased with an increase in temperature and humidity. When the transfer bias with the low duty is applied to increase the transferability onto the uneven surface sheet, the peak-to-peak value of the AC voltage and time-average voltage of the transfer bias are preferably reduced with an increase in temperature and humidity to prevent the occurrence of white spots due to the electric discharge. In other words, the correction in the AC component and the DC component differs between the high-duty transfer bias and the low-duty transfer bias. That is, not a single correction but different corrections are preferably performed for the high-duty transfer bias and the low-duty transfer bias, respectively. Further, different corrections are preferably performed for the high-duty transfer bias and the low-duty transfer bias, respectively, with respect to the changes in resistance and linear speed (printing speed) of rollers.

In the embodiments described above, the case in which the injection of electric charges into toner due to the use of the image bearer having the multilayer structure is described. However, this is merely one example. Even when using the image bearer without the multilayer structure, the insufficient image density might occur when the width of the secondary-transfer nip N (the width in the direction of conveyance of sheet) increases in the following cases in which the transfer nipping pressure of the apparatus increases, in which the intermediate transfer belt is wound around the secondary-transfer member (a secondary-transfer belt or a secondary-transfer roller) by a predetermined amount, and in which the linear speed of the apparatus decreases. Similarly, the insufficient image density might occur depending on the type of toner employed or the material of the image bearer (belt).

However, different correction values are set to the low-duty AC transfer mode and the high-duty AC transfer mode, respectively. For example, the high-duty AC transfer mode exhibits the above-described effects when the peak-to-peak value of the AC voltage and the time-average voltage of the transfer bias are increased with an increase in temperature and humidity. The low-duty AC transfer mode, which is selected for the uneven surface sheet, can prevent the occurrence of white spots due to the electric discharge when the peak-to-peak value of the AC voltage and the time-average voltage of the transfer bias are reduced with an increase in temperature and humidity. That is, a single correction is not sufficient to obtain the above-described effects.

Example 1

The following describes how to calculate each correction value in the present Example. However, no limitation is intended thereby. In the present Example, the following three corrections (the environment correction, the linear speed correction, and the sheet-size correction) are all used, but the present Example is not under the assumption that all of the three correction is used. For example, using one or two of the following three corrections allows exhibiting the advantageous effects.

In the environment correction, the environmental sections are preliminarily determined according to at least one of the temperature and the humidity. The image forming apparatus 1000 determines the environmental section according to at least one of the temperature and the humidity detected by the temperature-humidity sensor 106 (refer to FIGS. 1 and 3) as the environment sensor disposed the apparatus body, and further determines a correction value according to the determined environmental section. Table 1, as shown in FIG. 12, represents the environmental sections determined according to the temperature and the relative humidity, as one example. Alternatively, in some embodiments, the image forming apparatus 1000 may calculate the absolute humidity based on the temperature and relative humidity detected by the temperature-humidity sensor 106, and determines the environmental section among the environmental sections preliminarily set according to the absolute humidity, based on the calculated absolute humidity, thus determining a correction value. Table 2 represents the environmental sections determined according to the absolute humidity, as one example. In Tables 1 and 2, the environmental section "MM" refers to the moderate-temperature environment (moderate-temperature and moderate-humidity environment), the environmental section "LL" refers to the low-temperature environment (low-temperature and low-humidity environment), and the environmental section "HH" refers to the high-temperature environment (high-temperature and high-temperature environment). For example, when the temperature is 23° C. and the humidity is 50% RH, the environmental section is the moderate-temperature and moderate-temperature environment. When the temperature is 27° C. and the humidity is 80% RH, the environmental section is the high-temperature and high-temperature environment.

The temperature-humidity sensor 106 according to the present embodiment detects the temperature and the relative humidity. However, no limitation of the type of sensor is indicated thereby. In some embodiments, a temperature sensor that is capable of detecting only the temperature may be used instead of the temperature-humidity sensor 106. Alternatively, in some embodiments, a humidity sensor that is capable of detecting only the relative humidity may be used instead of the temperature-humidity sensor 106. See FIG. 1 and Table 2, as shown below.

TABLE 2

| Environment Section | Absolute Humidity D (g/m$^3$) |
|---|---|
| LL | D < 5.0 |
| MM | 5.0 ≤ D < 15.0 |
| HH | 15.0 ≤ D |

The degree (value) of the linear speed correction is determined according to the printing speed of the image forming apparatus 1000. In the present embodiment, the image forming apparatus 1000 has three linear speeds, the standard speed, the medium speed (70% of the standard speed), and the low speed (50% of the standard speed).

The sheet-size correction is determined according to three determination items, the main-scanning directional width of a sheet, the thickness of a sheet, and the combined resistance of the secondary-transfer unit as represented by Tables 3 through 5, each including three levels. In the present embodiment, the main-scanning directional width of a sheet and the thickness of a sheet are determined according to the setting conditions for the sheet tray 100.

The combined resistance of the secondary-transfer unit refers to the resistance of the current path including the secondary-transfer back surface roller 53, the intermediate transfer belt 51, and the nip forming roller 56 in the embodiment of FIG. 1. The resistance section is determined according to the voltage value calculated relative to the constant current (−50 ρA in the present embodiment) that flows in manufacturing, adjusting operation by the operator, or automatically adjusting operation, such as printing. A detector 203 as illustrated in FIGS. 5 and 6 detects the voltage output when the secondary-transfer bias power source 200 outputs the constant current to the secondary-transfer unit (the secondary-transfer nip N). Then, the detector 203 detects the resistance of the secondary-transfer unit based on the relation of the current and the voltage. The combined resistance of the secondary-transfer unit is calculated with no sheet disposed in the secondary-transfer nip N. In Table 5, R-L represents that combined resistance is low, R-M represents that the combined resistance is standard, and R-H represents that the combined resistance is high.

TABLE 3

| | Basis Weight |
|---|---|
| First Paper Thickness | 60 gsm through 120 gsm |
| Second Paper Thickness | 120.1 gsm through 200 gsm |
| Third Paper Thickness | 200.1 gsm through 300 gsm |

TABLE 4

| | Main-Scanning Directional Width W (mm) |
|---|---|
| First Size | 250 < W |
| Second Size | 180 < W ≤ 250 |
| Third Size | W ≤ 180 |

TABLE 5

| | Detected Voltage V (kV) |
|---|---|
| R-L | V ≤ 1.0 |
| R-M | 1.0 < V ≤ 3.0 |
| R-H | 3.0 < V |

The following correction values in the present embodiment are merely one example, and no limitation is intended thereby. Note that the correction values are represented in percentage (%) terms of the standard value. The specifications (the values of the voltage and the current) for the standard value are set as appropriate according to the configuration of the apparatus.

Table 6 represents the environment correction values according to the above-described environmental sections in the present embodiment.

The controller 300 controls the secondary-transfer bias power source 200 to change the DC component and the AC component according to the duty and at least one of the temperature and the humidity detected by the temperature-humidity sensor 106.

In the present embodiment, toner employed is charged with a negative polarity. With a reduction in temperature, the absolute value of the amount of charged toner increases (for example: the absolute value of −25 ρC/g increases to the absolute value of −40 μC/g). Accordingly, under the low-temperature environment (LL environment) relative to the moderate-temperature environment (MM environment), the controller 300 corrects the DC component and the AC component in the low-duty AC transfer mode to increase (in the positive direction) to be greater than the standard values. This can prevent the occurrence of insufficient density in recesses of a sheet. In contrast, with an increase in temperature, the absolute value of amount of charged toner decreases. Accordingly under the high-temperature environment (HH environment) relative to the moderate-temperature environment (MM environment), the controller 300 corrects the DC component and the AC component in the low-duty AC transfer mode to decrease to be smaller than the standard values. This can prevent the occurrence of abnormal images due to electric discharge of toner.

In the high-duty AC transfer mode, the amount of charged toner is relatively high under the low-temperature environment (LL environment) and thus no correction is performed. That is, the peak-to-peak value (the AC component) of the AC voltage and the time-average voltage (the DC component) are the same as those in the moderate-temperature environment (MM environment), thus remaining to be the standard values. This allows for an increase in transferability while providing an appropriate amount of transfer bias under the low-temperature environment (LL environment). Further, under the high-temperature environment (HH environment), the controller 300 corrects the peak-to-peak (the AC component) of the AC voltage and the time-overage voltage (the DC component) to increase compared to the standard values. In other words, the controller 300 increases the absolute values of the peak-to-peak (the AC component) of the AC voltage and time-average voltage (the DC component) under the high-temperature environment (HH environment) compared to under the moderate-temperature environment (MM environment). Such a correction increases the peak-voltage value Vr in the return direction (see the return-directional voltage peak value Vr in FIGS. 9 and 11) toward the opposite-polarity side, i.e., the positive-polarity side that is opposite to the polarity side to transfer toner onto a sheet.

The amount of charged toner under the high-temperature environment (the HH environment) is smaller than that under the moderate-temperature environment (the MM environment). However, increasing the value of Vr toward the positive-polarity side accelerates the injection of the electric charges having the same polarity as that of toner into toner, thus reliably preventing the reduction in amount of charged toner Q/M. Thus, the occurrence of insufficient image density in a sheet under the high-temperature environment (NH environment) can be reliably prevented.

In some embodiments, the controller 300 may correct the peak-to-peak (the AC component) of the AC voltage and the time-average voltage (the DC component) to decrease compared to the standard values, respectively. That is, the controller 300 may reduce the peak-to-peak (the AC component) of the AC voltage and the time-average voltage (the DC component) within the range that provides a sufficient amount of transfer bias.

In correcting the transfer bias according to the temperature and the humidity, the controller 300 may correct only the peak-to-peak (the AC component) of the AC voltage as described above while maintaining time-average voltage (the DC component) at the constant value irrespective of the temperature and the humidity.

TABLE 6

| | Low-Duty AC Transfer Mode | | | High-Duty AC Transfer Mode | | |
|---|---|---|---|---|---|---|
| | LL | MM | HH | LL | MM | HH |
| DC Component | 110% | 100% | 90% | 100% | 100% | 110% |
| AC Component | 120% | 100% | 80% | 100% | 100% | 110% |

Table 7 represents the correction values for the linear speed according to the above-described printing speed of the image forming apparatus 1000 in the present Example. The medium speed is 70% of the standard speed, and the low speed is 50% of the standard speed. Note that the printing speed is the speed of conveyance of a sheet passing through the secondary-transfer nip N.

The controller 300 controls the secondary-transfer bias power source 200 and the printing speed of a sheet. The controller 300 controls the speed of a sheet fed by the registration rollers 102, thus controlling the printing speed of a sheet.

The controller 300 controls the secondary-transfer bias power source 200 to change the DC component and the AC component according to the printing speed and the duty of the superimposed bias.

In the low-duty AC transfer mode, the DC component is under the constant current control. Accordingly, the controller 300 corrects the DC component to decrease compared to the standard value when the printing speed is lower than the standard speed. In this case, no correction according to the printing speed is performed on the AC component, which is under the constant voltage control, and thus the AC component is the same as the value at the standard speed. In some embodiments, the controller 300 may correct the AC component according to the printing speed within the range that does not effect the transferability.

In the high-duty AC transfer mode, the concept of the correction operation is substantially the same as in the low-duty AC transfer mode. With a decrease in speed, the time period in which toner remains within the secondary-transfer nip N increases, thereby increasing the time period for injection of charges into toner. In other words, the secondary-transfer bias is more likely to effect the amount of charged toner. In the present embodiment, with lower printing speeds, such as the medium speed and the low speed, to transfer an image, the controller 300 corrects the absolute value of the DC component to decrease to be smaller than the DC component at the standard speed while decreasing the absolute value of the DC component to be smaller than the DC component in the low-duty AC transfer mode.

For example, the controller 300 corrects the DC component to decrease to 50% of the original value at the low speed in the low-duty AC transfer mode. Further, the controller 300 corrects the DC component to decrease to 40% of the original value (i.e., the rate smaller than 50%) at the low speed in the high-duty AC transfer mode. In other words, the rate of decrease in DC component of the transfer bias having the duty of greater than or equal to 50% according to the printing speed (when the correction value at the standard speed is compared with the correction value at the low speed in the high-duty transfer mode in Table 7, the correction value changes from 100% to 40%, i.e., the rate of decrease in DC component is 60%) is greater than the rate of decrease in DC component of the transfer bias having the duty of less than 50% according to the printing speed. The rate of decrease in DC component in the low-duty transfer mode is 50% as can be seen from Table 7 representing that the correction value at the standard speed is 100% and the correction value at the low speed is 50%.

Such a control in transfer bias allows the transfer-directional peak value Vr of the transfer bias to be a positive-polarity side value in transferring an image at a lower printing speed. This can prevent injecting charges having an opposite polarity of the polarity of toner into toner, thereby preventing the occurrence of insufficient image density.

TABLE 7

| | Low-Duty AC Transfer Mode | | | High-Duty AC Transfer Mode | | |
|---|---|---|---|---|---|---|
| | Standard Speed | Medium Speed | Low Speed | Standard Speed | Medium Speed | Low Speed |
| DC Component | 100% | 70% | 50% | 100% | 65% | 40% |
| AC Component | 100% | 100% | 100% | 100% | 100% | 100% |

The following Tables 8 through 13 represent the correction values for the sheet-size correction according to the present Example, in the accordance with the above-described detection method (the correction values represented in Tables 8 through 10 are with respect to the low-duty AC transfer mode, and the correction values represented in Tables 11 through 13 are with respect to the high-duty AC transfer mode).

TABLE 8

| Resistance Section: R-L<br>Low-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 90% | 100% | 90% | 100% | 90% |
| Second Size | 140% | 90% | 170% | 90% | 200% | 90% |
| Third Size | 190% | 90% | 220% | 90% | 250% | 90% |

TABLE 9

| Resistance Section: R-M<br>Low-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 100% | 100% | 100% | 100% | 100% |
| Second Size | 120% | 100% | 130% | 100% | 140% | 100% |
| Third Size | 140% | 100% | 160% | 100% | 180% | 100% |

TABLE 10

| Resistance Section: R-H<br>Low-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 110% | 100% | 110% | 100% | 110% |
| Second Size | 105% | 110% | 110% | 110% | 115% | 110% |
| Third Size | 110% | 110% | 120% | 110% | 130% | 110% |

TABLE 11

| Resistance Section: R-L<br>High-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 110% | 100% | 110% | 100% | 110% |
| Second Size | 140% | 110% | 170% | 110% | 200% | 110% |
| Third Size | 190% | 110% | 220% | 110% | 250% | 110% |

TABLE 12

| Resistance Section: R-M High-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 100% | 100% | 100% | 100% | 100% |
| Second Size | 120% | 100% | 130% | 100% | 140% | 100% |
| Third Size | 140% | 100% | 160% | 100% | 180% | 100% |

TABLE 13

| Resistance Section: R-H High-Duty AC Transfer Mode | | | | | | |
|---|---|---|---|---|---|---|
| | First Paper Thickness | | Second Paper Thickness | | Third Paper Thickness | |
| Paper Size | DC Component | AC Component | DC Component | AC Component | DC Component | AC Component |
| First Size | 100% | 100% | 100% | 100% | 100% | 100% |
| Second Size | 105% | 100% | 110% | 100% | 115% | 100% |
| Third Size | 110% | 100% | 120% | 100% | 130% | 100% |

In both the low-duty AC transfer mode and the high-duty AC transfer mode, the correction value for the DC component is preferably increased (the value of "%" for correction increases) in the cases in which the main-scanning directional width of a sheet decreases, in which the thickness of a sheet increases, and in which the combined resistance decreases. This is because the DC component is under the constant current control and thereby the current increases in amount to leak out of the area of a sheet under any one of the above-described cases. Thus, the correction value is increased according to each of the above-described cases to provide a sufficient amount of transfer current.

The AC component, which is under the constant voltage control, has nothing to do with the leakage out of the area of a sheet, and accordingly the correction values for the AC component are the same irrespective of the size and thickness of the sheet.

Assuming that the AC component is corrected in the same manner as in the DC component, i.e., the AC component is corrected by the correction value for the DC component in the correction according the main-scanning directional width of a sheet, the AC component is excessively corrected, resulting in the occurrence of white spots in an image due to electric discharge. In some embodiments, the controller 300 may correct the AC component according to the printing speed within the range that does not affect the transferability.

However, in correcting the AC component relative to the combined resistance in the low-duty AC transfer mode, the controller 300 corrects the AC component to reduce the transfer bias (to be less than the standard value) with a decrease in combined resistance, and corrects the AC component to increase the transfer bias (to be greater than the standard value) with an increase in combined resistance. This is because a constant amount of voltage is preferably applied to the secondary-transfer nip N to transfer toner onto a sheet irrespective of the combined resistance, and accordingly the voltage to be applied to the secondary-transfer nip N is preferably increased when the combined resistance (particularly the resistance of the secondary-transfer back surface roller 53) is relatively high, thus preventing the decrease in voltage within the secondary-transfer nip N.

In correcting the AC component relative to the combined resistance in the high-duty AC transfer mode, the controller 300 preferably increases the peak-to-peak of the AC voltage and time-average voltage when the combined resistance is relatively low, so that a successful secondary transferability can be obtained. Thus, the correction value for the AC component in the high-duty AC transfer mode increases with a decrease in combined resistance, and the correction value for the AC component in the high-duty AC transfer mode decreases with an increase in combined resistance.

The correction according to the combined resistance may be performed independently of the correction according to the paper thickness and the correction according to the sheet size. In such a case, the AC component increases with an increase in combined resistance in the low-duty AC transfer mode as represented in Tables 8 through 10. On the other hand, the AC component increases with a decrease in combined resistance in the high-duty AC transfer mode as represented in Tables 11 through 13.

This configuration can prevent an insufficient image density in recesses of a sheet when the combined resistance is relatively high in the low-duty AC transfer mode, and also prevent the occurrence of abnormal images due to electric discharge in the low-duty AC transfer mode when the combined resistance is relatively low, the same as in correcting the DC component and the AC component according to the temperature and relative humidity. Further, such a configuration can increase the transferability when the combined resistance is relatively high in the high-duty AC transfer mode, and also reliably prevent the decrease in amount of charged toner Q/M when the combined resistance is relatively low in the high-duty AC transfer mode.

As described above, changing the correction values between the low-duty AC transfer mode and the high-duty AC transfer mode allows for a successful image transfer with appropriate values of the DC component and the AC component according to the correction condition.

Preferably, the correction rate of the AC component varies more greatly with a smaller-thickness recording sheet P than with a larger-thickness recording sheet P when the resistance of the transfer unit increases. This allows outputting the DC component and the AC component with appropriate values according to the thickness of a recording sheet P In Comparative Example 1 described below, the correction value for the transfer bias is common between the low-duty AC transfer mode and the high-duty AC transfer mode. Note that the configuration of the image forming apparatus and the manner in which the detection is performed for each correction operation in Comparative Example 1 are the same as in the present Example.

Comparative Example 1

In Comparative Example 1, the correction values of the AC component and the DC component as the environment correction factor in the high-duty AC transfer mode (Table 14) are the same as the correction values in the low-duty AC transfer mode (Table 6). The same as in Example 1 (Tables 7 through 13) applies to Comparative Example 1 except for the environment correction.

TABLE 14

| Comparative Example 1 | Low-Duty AC Transfer Mode High-Duty AC Transfer Mode in Common | | |
|---|---|---|---|
| Environment Correction | LL | MM | HH |
| DC Component | 110% | 100% | 90% |
| AC component | 120% | 100% | 80% |

In Example 1 and Comparative Example 1, image printing is performed under the following conditions to confirm the effects.

Printing Speed of The Image Forming Apparatus: the standard speed;

Secondary-Transfer Combined Resistance Section: R-M;

Environmental Conditions: the temperature of 10° C. and the relative humidity of 15% (the environmental section is LL), the temperature of 23° C. and the relative humidity of 50% (the environmental section is MM), and the temperature of 27° C. and the relative humidity of 80% (the environmental section is HH);

Main-Scanning Directional Width of Sheet: A4 horizontal (297 mm: size 1);

Sheet 1: Leathac 66, ream weight of 100 kg (basis weight of 116 gsm) (paper thickness 1);

Sheet 2: Print On Demand (POD) Gloss Coat 100 (basis weight of 100 gsm) (paper thickness 1);

Chart: Full solid image of blue color, and a full halftone image of cyan color, and Transfer Mode: the low-duty AC transfer mode for Leathac 66 and the high-duty AC transfer mode for POD Gloss Coat 100.

Table 15 represents the results. In Table 15, "GOOD" refers to no abnormal image, and "POOR" refers to the occurrence of abnormal image. Note that "Leathac" and "POD Gloss Coat" are both product names. POD Gloss Coat 100 is coated paper having a surface coated. The surface unevenness of POD Gloss Coat is smaller than the surface unevenness of Leathac 66.

TABLE 15

| | | LEATHAC 66 | | | POD GROSSED COAT | | |
|---|---|---|---|---|---|---|---|
| | | LL | MM | HH | LL | MM | HH |
| Solid (Blue) | Example 1 | GOOD | GOOD | GOOD | GOOD | GOOD | GOOD |
| | Comparative Example 1 | GOOD | GOOD | GOOD | GOOD | GOOD | POOR |
| Halftone (Cyan) | Example 1 | GOOD | GOOD | GOOD | GOOD | GOOD | GOOD |
| | Comparative Example 1 | GOOD | GOOD | GOOD | POOR | GOOD | POOR |

In Example 1 in which the low-duty AC transfer mode and the high-duty AC transfer mode have different correction tables, no abnormal images occurred in each environmental section. By contrast, in Comparative Example 1 in which the correction table is common between the low-duty AC transfer mode and the high-duty AC transfer mode, no abnormal images occurred in the Leathac 66. However, with the POD gloss coated paper, the transferability decreased due to the injection of charges to toner because the correction was insufficient in the HH (high temperature and high humidity) environment. Thus, white spots occurred in the images due to transfer failure. The present inventors has confirmed, from the above-described results, the advantageous effects in preparing different correction tables for the environmental section between the low-duty AC transfer mode and the high-duty AC transfer mode.

Comparative Example 2

In Comparative Example 2, the correction values of the AC component and the DC component as the linear-speed correction factor in the high-duty AC transfer mode (Table 16) are the same as the correction values in the low-duty AC transfer mode (Table 6). The same as in Example 1 (Tables 6, 8 through 13) applies to Comparative Example 2 except for the linear-speed correction.

TABLE 16

| | Low-Duty AC Transfer Mode High-Duty AC Transfer Mode in Common | | |
|---|---|---|---|
| Comparative Example 2 Linear-Speed Correction | Standard Speed | Medium Speed | Low Speed |
| DC Component | 100% | 70% | 50% |
| AC Component | 100% | 100% | 100% |

In Example 1 and Comparative Example 2, image printing is performed under the following conditions to observe the effects.

Printing Speed of Image Forming Apparatus: see the following items of "sheet";

Secondary-Transfer Combined Resistance Section: R-M;

Environmental Conditions: the temperature of 23° C. and the relative humidity of 50% (the environmental section is MM);

Main-Scanning Directional Width of Sheet: A4 horizontal (297 mm: size 1);

Sheet 1: Leathac 66, ream weight of 130 kg (basis weight of 151 gsm) (paper thickness 2: the middle printing speed);

Sheet 2: POD Gloss Coat 128 (basis weight of 128 gsm) (paper thickness 2: the middle printing speed);

Sheet 3: LAID Unwatermarked Hi White 300 gsm, manufactured by Conqueror (paper thickness 3: the low printing speed);

Sheet 4: Magno Star 300 gsm (paper thickness 3: the low printing speed);

Chart: Full solid image of blue color, and a full halftone image of cyan color; and Transfer Mode: the low-duty AC transfer mode for Sheet 1 and Sheet 3 and the high-duty AC transfer mode for Sheet 2 and Sheet 4.

Table 17 represents the results. In Table 17, "GOOD" refers to no abnormal image, and "POOR" refers to abnormal image. Note that "LAID Unwatermarked Hi White" and "Magno Star" are both product names.

TABLE 17

| | | Middle Speed | | Low Speed | |
|---|---|---|---|---|---|
| | | First Sheet | Second Sheet | Third Sheet | Four Sheet |
| Solid (Blue) | Example 1 | GOOD | GOOD | GOOD | GOOD |
| | Comparative Example 2 | GOOD | POOR | GOOD | POOR |
| Halftone (Cyan) | Example 1 | GOOD | GOOD | GOOD | GOOD |
| | Comparative Example 2 | GOOD | POOR | GOOD | POOR |

In Example 1 in which the low-duty AC transfer mode and the high-duty AC transfer mode have different correction tables, no abnormal images occurred in each printing speed. By contrast, in Comparative Example 2 in which the correction table is common between the low-duty AC transfer mode and the high-duty AC transfer mode, the white spots occurred in images at the medium speed and the low speed in the high-duty AC transfer mode. This is because the transfer bias was lacking in the DC component, thereby failing to prevent the injection of charges into toner, resulting in transfer failure. The present inventors have confirmed, from the above-described results, the advantageous effects in preparing different correction tables between the low-duty AC transfer mode and the high-duty AC transfer mode, with respect to the correction according to the linear velocity.

Comparative Example 3

In Comparative Example 3, the correction values are the same as in the low-duty AC transfer mode in correcting the transfer bias according to the main-scanning directional width of sheet with paper thickness 1 and the resistance section of R-L. The correction values are represented in Table 8. The same as in Example 1 (Tables 7 through 13) applies to Comparative Example 1 except for the sheet-size correction.

In Example 1 and Comparative Example 3, image printing is performed under the following conditions to observe the effects.

Printing Speed of Image Forming Apparatus: the standard speed;

Secondary-Transfer Combined Resistance Section: R-L;

Environmental Conditions: the temperature of 23° C. and the relative humidity of 50% (the environmental section is MM);

Main-Scanning Directional Width of Sheet: A4 horizontal (297 mm: size 1) and A4 vertical (148.5 mm: size 3);

Sheet 1: Leathac 66, ream weight of 100 kg (basis weight of 116 gsm) (paper thickness 1);

Sheet 2: Print On Demand (POD) Gloss Coat 100 (basis weight of 100 gsm) (paper thickness 1);

Chart: Full solid image of blue color, and a full halftone image of cyan color; and Transfer Mode: the low-duty AC transfer mode for Leathac 66 and the high-duty AC transfer mode for POD Gloss Coat 100.

Table 18 represents the results. In Table 18, "GOOD" refers to no abnormal image, and "POOR" refers to abnormal image.

TABLE 18

| | | LEATHAC 66 | | POD GROSSED COAT | |
|---|---|---|---|---|---|
| | | First Size | Third Size | First Size | Third Size |
| Solid (Blue) | Example 1 | GOOD | GOOD | GOOD | GOOD |
| | Comparative Example 3 | GOOD | GOOD | POOR | POOR |
| Halftone (Cyan) | Example 1 | GOOD | GOOD | GOOD | GOOD |
| | Comparative Example 3 | GOOD | GOOD | POOR | POOR |

In Example 1 in which the low-duty AC transfer mode and the high-duty AC transfer mode have different correction tables, no abnormal images occurred in each environmental section. By contrast, in Comparative Example 1 in which the correction table is common between the low-duty AC transfer mode and the high-duty AC transfer mode, no abnormal images occurred in the Leathac 66. However, with the POD gloss coated paper, the white spots occurred in solid and halftone images due to transfer failure caused by an insufficient amount of the AC component. Accordingly, the present inventors have confirmed, from the above-described results, the advantageous effects in preparing different correction tables between the low-duty AC transfer mode and the high-duty AC transfer mode, with respect to the correction according to the main-scanning directional width of sheet.

The following describes the configuration of the power source 200 for outputting the superimposed bias and the method for correcting the output of the power source 200 via the controller 300. The power source 200 is configured to output the superimposed bias, in which the AC voltage including the predetermined duty and the predetermined peak-to-peak voltage Vpp is superimposed on the time-average voltage Vave, to the secondary-transfer unit. That is, the power source 200 includes the DC power source 201 to output the time-average voltage Vave and the AC power source 202 to output the AC voltage. The DC power source 201 and the AC power source 202 are connected in series. The controller 300 controls the power source 200 to change the time-average voltage Vave and the AC voltage Vpp according to duty.

In some embodiments, the power source 200 may be configured to output the superimposed bias, in which the AC voltage including the predetermined duty and the predetermined peak-to-peak voltage Vpp is superimposed on the center value Voff, to the secondary-transfer unit. That is, the power source 200 includes the DC power source to output the center value Voff and the AC power source to output the AC voltage. The DC power source is connected to the AC power source in series. Further, the power source 200 is configured to correct the center value Voff and the AC voltage according to the temperature and humidity, the paper thickness, the sheet size, and the resistance of the transfer unit. The power source 200 is further configured to changes the method for correcting the center value Voff and the AC voltage according to duty. Such a configuration also allows for the same advantageous effects as in the above-described embodiments.

The image forming apparatus 1000 according to the present disclosure allows adjusting the DC component and the AC component of transfer bias according to various conditions, resulting in successful transfer of images.

The image forming apparatus 1000 according to the present disclosure includes an environment sensor to detect the environmental conditions in the interior of the image forming apparatus 1000. The controller 300 controls the secondary-transfer bias 200 to change the degrees of the DC component and the AC component according to the detection results of the environment sensor. This allows obtaining a favorable transfer image irrespective of the environmental conditions.

When the time-average value (Vave) of the transfer bias is on the transfer-directional side relative to the center value (Voff), the controller 300 increases the transfer bias to be greater than the standard value as at least one of the temperature and humidity detected by the environment sensor decreases. This can provide a sufficient amount of transfer bias even in the low-temperature environment.

When the time-average value (Vave) of the transfer bias is on the transfer-directional side relative to the center value (Voff), the controller 300 reduces the transfer bias to be lower than the standard value as at least one of the temperature and humidity detected by the environment sensor increases. This can provide an appropriate amount of transfer bias for the amount of charged toner in the high-temperature environment.

When the time-average value (Vave) of the return bias is on the return-directional side relative to the center value (Voff), the controller 300 maintains the transfer bias at the standard value in the low-temperature environment where at least one of the temperature and humidity detected by the environment sensor decreases is relatively low. This can provide an appropriate amount of transfer bias for the amount of charged toner in the low-temperature environment.

When the time-average value (Vave) of the effect is on the return-directional side relative to the center value (Voff), the controller 300 increases the transfer bias to be greater than the standard value as at least one of the temperature and humidity detected by the environment sensor increases. This can exhibit the advantageous effects of the superimposed voltage in the high-temperature environment.

Further, the controller 300 changes the DC component and the AC component according to the printing speed, thereby providing an appropriate amount of transfer bias according to the printing speed, thus allowing for a successful image transfer.

Further, the controller 300 reduces the DC component of the transfer bias to be smaller than the standard value and maintains the AC component of the transfer bias at the standard value as the printing speed slows down relative to the standard speed. This can provide an appropriate amount of transfer bias according to the printing speed to achieve a successful image transfer with the DC component under the constant current control.

The correction amount of the DC component, which changes with a decrease in printing speed, when the time-average value (Vave) of the transfer bias is on the return-directional side relative to the center value (Voff) is greater than the correction amount of the DC component, which changes with a reduction in the printing speed when the time-average value (Vave) of the transfer bias is on the transfer-directional side relative to the center value (Voff).

With changes in the DC component and the AC component according to the conditions for the recording sheet P, a successful image transfer can be achieved with an appropriate transfer bias irrespective to the conditions for the recording sheet P.

Further, the controller 300 reduces the DC component of the transfer bias to be greater than the standard value and maintains the AC component of the transfer bias at the standard value as the main-scanning directional width of recording sheet decreases. This can provide an appropriate amount of transfer bias relative to a recording sheet P, thus achieving a successful image transfer.

Further, the controller 300 increases the DC component of the transfer bias to be greater than the standard value and maintains the AC component at the standard value as the thickness of the recording sheet P increases. This can provide an appropriate transfer bias relative to a recording sheet P, thus achieving a successful image transfer.

The controller 300 increases the DC component of the transfer bias to be greater than the standard value and maintains the AC component at the standard value as the resistance value of the transfer unit decreases. This can provide a sufficient amount of current of the transfer bias, thus achieving a successful image transfer.

When the surface unevenness of a recording sheet P is greater than the predetermined value, the controller 300 controls the power source 200 to output the transfer bias with low duty. When the surface unevenness of the recording sheet P is smaller than the predetermined value, the controller 300 controls the power source 200 to output the transfer bias with high duty. This configuration allows for a successful image transfer in both of the recording sheet P having a greater surface unevenness and the recording sheet P having a smaller surface unevenness.

The image bearer includes a plurality of layers, such as a base layer and an elastic layer disposed on the base layer. In such a configuration, the elastic layer having elasticity flexibly deforms in the transfer nip N, thereby enhancing contact of the recording sheet P having a greater surface unevenness and the image bear, thus further increasing the transferability of a toner image onto the recording sheet P having a greater surface unevenness.

The configurations of the fixing devices 20, 20S, and 20T are not limited to those of the exemplary embodiments described above. For the transfer unit and the power source 200, different configurations can be adopted as appropriate.

In addition, the configuration of the image forming apparatus 1000 is also arbitrary and the order of colors is also arbitrary. The present disclosure may also be applied to a full-color apparatus using five colors or more of toner, three colors of toner, and a monochrome machine using two colors of toner. The present disclosure may also be applied to an image forming apparatus without an intermediate transferor to directly transfer toner from an image bearer, such as a photoconductor, onto a sheet, i.e., a direct-transfer image forming apparatus.

In some embodiments, the bias in which the DC component is under the constant voltage control may be employed as the secondary-transfer bias. Alternatively, the bias in which the AC component is under the constant voltage control may be employed as the secondary-transfer bias.

In the above-described embodiments, the cases in which the DC component and the AC component of the secondary-transfer bias are changed with the temperature in the three steps as indicated in Table 6 are described. In some embodiments, the DC component and the AC component may be changed in two steps or may be minutely changed in four or more steps. The same applies to the cases in which the DC component and the AC component change with the print speed. Further, the same also applies to the cases in which the DC component and the AC component change with the resistance of the transfer unit.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer;

a transfer-bias power source to output a transfer bias including a direct current (DC) component and an alternating current (AC) component to transfer a toner image from the image bearer to a recording sheet;

an environment sensor to detect at least one of temperature and humidity within the image forming apparatus; and a controller to control, according to (i) the at least one of temperature and humidity detected by the environment sensor and (ii) a duty of the transfer bias, the transfer-bias power source to change the DC component and the AC component, the duty being A/(A+B)×100[%]

where

A denotes an area on a return-directional side to move toner from the recording sheet back to the image bearer, relative to a center value (Voff) of a maximum value and a minimum value of the transfer bias in one cycle of a waveform of the transfer bias A=a return-directional time period $t_1$×|Voff—a return-directional voltage peak value $V_{rdp}$|, B denotes an area on a transfer-directional side to move the toner from the image bearer to the recording sheet, relative to the center value (Voff) in the one cycle, B=a transfer-directional time period $t_2$×|Voff—a transfer-directional voltage peak value $V_{tdp}$|.

2. The image forming apparatus according to claim 1, wherein when the duty is less than 50%, the controller increases an absolute value of the DC component and the AC component as the at least one of temperature and humidity decreases.

3. The image forming apparatus according to claim 1, wherein when the duty is greater than 50%, the controller increases an absolute value of the DC component and the AC component as the at least one of temperature and humidity increases.

4. The image forming apparatus according to claim 1, wherein when the duty is greater than 50% and the at least one of temperature and humidity is equal to or greater than a predetermined value, the controller increases an absolute value of the DC component and the AC component as the at least one of temperature and humidity increases, and wherein when the duty is greater than 50% and the at least one of temperature and humidity is lower than the predetermined value, the controller maintains the absolute value of the DC component and the AC component to be constant irrespective of the at least one of temperature and humidity.

5. The image forming apparatus according to claim 1, wherein when a surface unevenness of the recording sheet is greater than a prescribed value, the controller controls the transfer-bias power source to output the transfer bias having the duty of less than 50% to transfer the toner image from the image bearer to the recording sheet, and wherein when the surface unevenness of the recording sheet is less than the prescribed value, the controller controls the transfer-bias power source to output the transfer bias having the duty of greater than 50% to transfer the toner image from the image bearer to the recording sheet.

6. The image forming apparatus according to claim 1, further comprising an operation unit to select between a first mode and a second mode to transfer the toner image from the image bearer to the recording sheet, wherein in the first mode, the controller controls the transfer-bias power source to output the transfer bias having the duty of less than 50%, and wherein in the second mode, the controller controls the transfer-bias power source to output the transfer bias having the duty of greater than 50%.

7. The image forming apparatus according to claim 1, further comprising an operation circuit to select a type of the recording sheet, wherein the controller controls the transfer-bias power source to output one of the transfer bias having the duty of less than 50% and the transfer bias having the duty of greater than 50% according to the type of the recording sheet selected by the operation circuit.

8. The image forming apparatus according to claim 1, wherein the image bearer includes a plurality of layers including a base layer and an elastic layer disposed on the base layer.

9. An image forming apparatus comprising:

an image bearer;

a transfer-bias power source to output a transfer bias including a direct current (DC) component and an alternating current (AC) component to transfer a toner image from the image bearer to a recording sheet; and a controller to control a printing speed and the transfer-bias power source to change the DC component and the AC component, according to the printing speed and a duty of the transfer bias, the duty being A/(A+B)×100[%]

where

A denotes an area on a return-directional side to move toner from the recording sheet back to the image bearer, relative to a center value (Voff) of a maximum value and a minimum value of the transfer bias in one cycle of a waveform of the transfer bias A=a return-directional time period $t_1 \times |Voff—a$ return-directional voltage peak value $V_{rdp}|$, B denotes an area on a transfer-directional side to move the toner from the image bearer to the recording sheet, relative to the center value (Voff) in the one cycle, B=a transfer-directional time period $t_2 \times |Voff—a$ transfer-directional voltage peak value $V_{tdp}|$.

10. The image forming apparatus according to claim 9, wherein the controller controls the transfer-bias power source to decrease an absolute value of the DC component of the transfer bias as the printing speed decreases.

11. The image forming apparatus according to claim 10, wherein a rate of decrease in the DC component of the transfer bias having the duty of greater than 50% according to the printing speed is greater than a rate of decrease in the DC component of the transfer bias having the duty of less than 50% according to the printing speed.

12. The image forming apparatus according to claim 9, wherein when a surface unevenness of the recording sheet is greater than a prescribed value, the controller controls the transfer-bias power source to output the transfer bias having the duty of less than 50% to transfer the toner image from the image bearer to the recording sheet, and wherein when the surface unevenness of the recording sheet is less than the prescribed value, the controller controls the transfer-bias power source to output the transfer bias having the duty of greater than 50% to transfer the toner image from the image bearer to the recording sheet.

13. The image forming apparatus according to claim 9, further comprising an operation circuit to select between a first mode and a second mode to transfer the toner image from the image bearer to the recording sheet, wherein in the first mode, the controller controls the transfer-bias power source to output the transfer bias having the duty of less than 50%, and wherein in the second mode, the controller controls the transfer-bias power source to output the transfer bias having the duty of greater than 50%.

14. The image forming apparatus according to claim 9, further comprising an operation circuit to select a type of the recording sheet, wherein the controller controls the transfer-bias power source to output one of the transfer bias having the duty of less than 50% and the transfer bias having the duty of greater than 50% according to the type of the recording sheet selected by the operation circuit.

15. The image forming apparatus according to claim 9, wherein the image bearer includes a plurality of layers including a base layer and an elastic layer disposed on the base layer.

16. An image forming apparatus comprising:

an image bearer;

a transfer-bias power source to output a transfer bias including a direct current (DC) component and an alternating current (AC) component;

a transfer circuit to receive the transfer bias to transfer a toner image from the image bearer to a recording sheet;

a detector to detect a resistance of the transfer circuit; and a controller to control the transfer-bias power source to change the AC component, according to the resistance of the transfer circuit detected by the detector and a duty of the transfer bias, the duty being A/(A+B)×100[%]

where

A denotes an area on a return-directional side to move toner from the recording sheet back to the image bearer, relative to a center value (Voff) of a maximum value and a minimum value of the transfer bias in one cycle of a waveform of the transfer bias A=a return-directional time period $t_1 \times |Voff—a$ return-directional voltage peak value $V_{rdp}|$, B denotes an area on a transfer-directional side to move the toner from the image bearer to the recording sheet, relative to the center value (Voff) in the one cycle, B=a transfer-directional time period $t_2 \times |Voff—a$ transfer-directional voltage peak value $V_{tdp}|$.

17. The image forming apparatus according to claim 16, wherein when the duty is less than 50%, the controller controls the transfer-bias power source to increase the AC component as the resistance of the transfer circuit increases.

18. The image forming apparatus according to claim 16, wherein when the duty is greater than 50%, the controller controls the transfer-bias power source to increase the AC component as the resistance of the transfer circuit decreases.

19. The image forming apparatus according to claim 16, wherein when a surface unevenness of the recording sheet is greater than a prescribed value, the controller controls the transfer-bias power source to output the transfer bias having the duty of less than 50% to transfer the toner image from the image bearer to the recording sheet, and wherein when the surface unevenness of the recording sheet is less than the prescribed value, the controller controls the transfer-bias power source to output the transfer bias having the duty of greater than 50% to transfer the toner image from the image bearer to the recording sheet.

20. The image forming apparatus according to claim 16, further comprising an operation circuit to select between a first mode and a second mode to transfer the toner image from the image bearer to the recording sheet, wherein in the first mode, the controller controls the transfer-bias power source to output the transfer bias having the duty of less than 50%, and wherein in the second mode, the controller controls the transfer-bias power source to output the transfer bias having the duty of greater than 50%.

* * * * *